US011505393B1

(12) United States Patent
Parella

(10) Patent No.: US 11,505,393 B1
(45) Date of Patent: Nov. 22, 2022

(54) PACKAGING ASSEMBLY WITH MULTI-SLIT SUPPORT INSERT

(71) Applicant: Rational Packaging LLC, Springfield, TN (US)

(72) Inventor: Shawn M. Parella, Greenbrier, TN (US)

(73) Assignee: Rational Packaging LLC, Springfield, TN (US)

( * ) Notice: Subject to any disclaimer, the term of this patent is extended or adjusted under 35 U.S.C. 154(b) by 0 days.

(21) Appl. No.: 17/496,973

(22) Filed: Oct. 8, 2021

Related U.S. Application Data

(63) Continuation-in-part of application No. 16/922,772, filed on Jul. 7, 2020, now Pat. No. 11,208,253.

(51) Int. Cl.
*B65D 81/05* (2006.01)
*B65D 85/68* (2006.01)

(52) U.S. Cl.
CPC ..... *B65D 81/054* (2013.01); *B65D 85/68* (2013.01); *B65D 2585/6855* (2013.01)

(58) Field of Classification Search
CPC ..... B65D 81/054; B65D 2581/053; B65D 2581/058
USPC ..... 206/586, 592, 594
See application file for complete search history.

(56) References Cited

U.S. PATENT DOCUMENTS 3,049,260 A * 8/1962 Stone ..... B65D 81/056 217/53
3,244,347 A * 4/1966 Jenk ..... B65D 5/5033 217/53
3,734,389 A * 5/1973 Brown ..... B65D 81/054 206/320
3,896,930 A * 7/1975 Collin ..... D06F 39/001 68/3 R
3,982,682 A * 9/1976 Fremion ..... B65D 5/5033 206/521
4,125,187 A * 11/1978 Vecchiotti ..... H01M 50/10 220/675
4,399,915 A * 8/1983 Sorenson ..... B65D 5/5033 206/453
4,482,054 A * 11/1984 Gardner ..... B65D 81/05 206/320
4,742,916 A * 5/1988 Galea ..... B65D 81/054 217/53
4,771,893 A * 9/1988 Liebel ..... B65D 81/054 206/326

(Continued)

*Primary Examiner* — Jacob K Ackun

(74) *Attorney, Agent, or Firm* — Shaddock Law Group, PC

(57) ABSTRACT

A packaging assembly, including corrugated corner elements, each having a first corner post element leg and a second corner post element leg, each corner post element leg having one or more alternating ridges and grooves; endcap elements, each having a support layer portion and a tray layer portion, wherein the tray layer portion includes a corner recess formed proximate each corner of the support layer portion, wherein each corner recess is formed to allow at least a portion of one of the corrugated corner elements at least partially therein; and a multi-slit support insert having slits formed along at least a portion of the multi-slit support insert body, leaving a remaining portion of the multi-slit support insert body defining a web, wherein at least a portion of the multi-slit support insert body is bent to be fitted within a portion of the packaging assembly.

20 Claims, 27 Drawing Sheets

(56) References Cited

U.S. PATENT DOCUMENTS 5,131,541 A * 7/1992 Liebel ..... B65D 71/0096 206/453
5,267,651 A * 12/1993 Hughes ..... B65D 5/5033 206/453
5,593,039 A * 1/1997 Ortlieb ..... B65D 81/054 206/320
6,059,104 A * 5/2000 Widman ..... B65D 81/054 206/320
6,186,329 B1 * 2/2001 Qiu ..... B65D 5/5033 206/320
6,234,314 B1 * 5/2001 Qiu ..... B65D 5/5033 206/320
6,247,596 B1 * 6/2001 Muyskens ..... B65D 81/054 206/586
6,286,683 B1 * 9/2001 Hunt ..... B65D 81/054 206/320
6,513,662 B1 * 2/2003 Stebelton ..... B65D 81/054 206/586
6,520,336 B2 * 2/2003 Baechle ..... B65D 81/054 206/320
6,595,367 B2 * 7/2003 Baechle ..... B65D 81/054 428/36.9
7,014,046 B2 * 3/2006 Niu ..... B65D 81/054 206/320
7,048,118 B2 * 5/2006 Baechle ..... B65D 61/00 206/320
7,111,735 B2 * 9/2006 Lowry ..... B65D 5/52 206/766
7,128,214 B2 * 10/2006 Qiu ..... B65D 81/054 206/586
7,137,517 B2 * 11/2006 Lowry ..... B65D 21/0215 229/199
7,258,319 B2 * 8/2007 Johanson ..... B65D 19/0002 108/51.11
7,281,648 B2 * 10/2007 Lowry ..... B65D 13/04 229/199
7,625,616 B2 * 12/2009 Van de Camp ..... B65D 81/053 206/586
7,841,469 B2 * 11/2010 Muyskens ..... B65D 81/054 206/453
8,061,521 B1 * 11/2011 Lowry ..... B65D 19/44 206/592
8,074,952 B2 * 12/2011 Baechle ..... D06F 39/001 229/113
8,079,476 B2 * 12/2011 Simms ..... B65D 81/054 206/453
8,297,492 B2 * 10/2012 Muyskens ..... B65D 5/5045 229/199
8,955,812 B2 * 2/2015 Marrow ..... B65D 19/44 248/346.02
9,428,298 B2 * 8/2016 Bersamin ..... B65D 5/006
10,822,138 B1 * 11/2020 Voorhees ..... B65D 81/053
11,208,253 B1 * 12/2021 Parella ..... B65D 81/05
2002/0189969 A1 * 12/2002 Renck ..... B65D 81/054 206/453
2003/0052037 A1 * 3/2003 Baechle ..... B65D 81/054 248/188.9
2005/0035257 A1 * 2/2005 Niu ..... B65D 81/054 248/345.1
2005/0092633 A1 * 5/2005 Baechle ..... B65D 61/00 206/320
2005/0092634 A1 * 5/2005 Baechle ..... B65D 61/00 206/320
2005/0136204 A1 * 6/2005 Qiu ..... B31F 1/007 156/203
2006/0070911 A1 * 4/2006 Lowry ..... B65D 71/403 206/386
2006/0108408 A1 * 5/2006 Lowry ..... B65D 5/321 229/199
2006/0157380 A1 * 7/2006 Lowry ..... B65D 5/5033 206/594
2006/0292368 A1 * 12/2006 Van De Camp ..... B65D 81/053 428/364
2008/0237419 A1 * 10/2008 Baechle ..... B65D 19/20 248/219.2
2008/0264806 A1 * 10/2008 Trebilcock ..... D06F 39/001 206/207
2010/0000906 A1 * 1/2010 Muyskens ..... B65D 81/054 206/586
2011/0132799 A1 * 6/2011 Lee ..... B65D 81/054 206/586
2011/0240498 A1 * 10/2011 Trebilcock ..... D06F 39/001 206/320
2011/0278310 A1 * 11/2011 Muyskens ..... B65D 5/5033 220/646
2015/0122690 A1 * 5/2015 Bersamin ..... A47F 5/114 229/199
2018/0086532 A1 * 3/2018 Bélanger ..... B65D 81/053

* cited by examiner

PACKAGING ASSEMBLY WITH MULTI-SLIT SUPPORT INSERT

CROSS-REFERENCE TO RELATED APPLICATIONS

This patent application is a continuation-in-part of U.S. patent application Ser. No. 16/922,772, filed Jul. 7, 2020, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of packaging assemblies. More specifically, the present disclosure relates to a packaging assembly with a support insert.

2. Description of Related Art

It is generally known to use various packaging assemblies to package products for storage or shipping. Typically, packaging assemblies are constructed to stabilize the contained item or items and provide a certain degree of cushioning against breakage, while being moved or transported.

Depending on the size, shape, and/or weight of the contained item or items, packaging assemblies may be placed atop one another or pallets for storage, shipping, or transportation.

When packaging items for shipment, particularly oven ranges or other appliances having a partial glass door, a "door board" is used. The door board is typically a flat piece of cardboard or paperboard that extends out of the door of the appliance to transfer front impact force into the deeply drawn steel baking cavity instead of the glass door.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, typical packaging assemblies have various shortcomings. Among other things, known packaging assemblies do not efficiently or effectively secure portions of an article or product, such as, for example, a door of an appliance.

According to various exemplary embodiments of the present disclosure, a support insert is provided which protects various portions of an article or product, such as, for example, a door of a front loading laundry washer or dryer.

In various exemplary, non-limiting embodiments, the packaging assembly comprises one or more corrugated corner elements, each of the corrugated corner elements having an inner wall and an outer wall and extending, along a longitudinal axis, from a first end portion to a second end portion, a vertex of each of the corrugated corner elements extending along the longitudinal axis; each of the corrugated corner elements having a first corner post element leg, extending laterally from the vertex, the first corner post element leg having one or more alternating ridges and grooves, each of the alternating ridges and grooves of the first corner post element leg extending along the longitudinal axis of each of the corrugated corner elements; each of the corrugated corner elements having a second corner post element leg, extending laterally from the vertex and away from the first corner post element leg, the second corner post element leg having one or more alternating ridges and grooves, each of the alternating ridges and grooves of the second corner post element leg extending along the longitudinal axis of each of the corrugated corner elements; at least two spaced endcap elements, wherein each endcap element comprises a support layer portion and a tray layer portion, wherein the support layer portion extends to four corners, wherein the tray layer portion includes a corner recess formed proximate each corner of the support layer portion, and wherein each of the corrugated corner elements is formed to be at least partially positioned within a respective one of the corner recesses; and a support insert having a support insert body extending from a first end to a second end, wherein a void or gap is formed through a portion of the support insert body, extending from the first end to the second end, wherein a relief recess is formed within at least a portion of the support insert body, extending from the first end into at least a portion of the support insert body to allow at least a portion of one of the corrugated corner elements to be fitted within at least a portion of the relief recess, wherein a scalloped relief recess is formed within at least a portion of the support insert body, extending from the first end into at least a portion of the support insert body to allow at least a portion of one of the corrugated corner elements to be fitted within at least a portion of the scalloped relief recess, wherein one or more projections extend within a portion of the scalloped relief recess, from a lower wall portion of the scalloped relief recess toward the first end, wherein each of the one or more projections extends to interface with at least one of the grooves formed in the inner wall of the corrugated corner element.

In certain exemplary, non-limiting embodiments, the support insert body forms a partial cylinder, having a substantially circular cross-sectional view.

In certain exemplary, non-limiting embodiments, the void or gap allows for a degree of flexion of the support insert body.

In certain exemplary, non-limiting embodiments, the relief recess extends on either side of the void or gap.

In certain exemplary, non-limiting embodiments, the scalloped relief recess is formed substantially opposite the relief recess.

In certain exemplary, non-limiting embodiments, two or more projections extend within the scalloped relief recess and wherein each of the projections extend and are aligned to matingly correspond to and interface with the same groove.

In certain exemplary, non-limiting embodiments, the tray layer portion comprises a separate portion of material that is attached or coupled to the support layer portion.

In certain exemplary, non-limiting embodiments, the tray layer portion and the support layer portion are formed integral to one another to form a monolithic endcap element.

In certain exemplary, non-limiting embodiments, each of the corrugated corner elements is formed to be at least partially flexed inwardly, relative to the vertex, to be positioned within a respective one of the corner recesses.

In certain exemplary, non-limiting embodiments, each corner recess is formed to substantially abut at least a portion of an inner wall of at least a first end portion or a second end portion of each of the corrugated corner elements.

In various other exemplary, non-limiting embodiments, the packaging assembly comprises four corrugated corner elements, each of the corrugated corner elements having an outer wall and an opposing inner wall, each of the corrugated corner elements extending lengthwise, along a longitudinal axis, continuously from a first end portion to a second end portion, each of the corrugated corner elements having a first corner post element leg, the first corner post element leg having one or more alternating ridges and grooves, each of the alternating ridges and grooves extending along the longitudinal axis of each of the corrugated corner elements; each of the corrugated corner elements having a second corner post element leg, the second corner post element leg having one or more alternating ridges and grooves, each of the alternating ridges and grooves extending along the longitudinal axis of each of the corrugated corner elements, the first corner post element leg and the second corner post element leg each extending laterally from a vertex, the vertex extending along the longitudinal axis of each of the corrugated corner elements; two spaced endcap elements, wherein each endcap element comprises a support layer portion and a tray layer portion, wherein the support layer portion extends to four corners, wherein the tray layer portion includes a corner recess formed proximate each corner of the support layer portion, and wherein each of the corrugated corner elements is formed to be at least partially positioned within a respective one of the corner recesses; and a support insert having a support insert body extending from a first end to a second end, wherein a void or gap is formed through a portion of the support insert body, extending from the first end to the second end, wherein a relief recess is formed within at least a portion of the support insert body, extending from the first end into at least a portion of the support insert body to allow at least a portion of one of the corrugated corner elements to be fitted within at least a portion of the relief recess, wherein a scalloped relief recess is formed within at least a portion of the support insert body, extending from the first end into at least a portion of the support insert body to allow at least a portion of one of the corrugated corner elements to be fitted within at least a portion of the scalloped relief recess, wherein one or more projections extend within a portion of the scalloped relief recess, from a lower wall portion of the scalloped relief recess toward the first end, wherein each of the one or more projections extends to interface with at least one of the grooves formed in the inner wall of the corrugated corner element.

In certain exemplary, non-limiting embodiments, the support insert body forms a partial cylinder, having a substantially circular cross-sectional view.

In certain exemplary, non-limiting embodiments, the void or gap allows for a degree of flexion of the support insert body.

In certain exemplary, non-limiting embodiments, the relief recess extends on either side of the void or gap.

In certain exemplary, non-limiting embodiments, the scalloped relief recess is formed substantially opposite the relief recess.

In certain exemplary, non-limiting embodiments, two or more projections extend within the scalloped relief recess and wherein each of the projections extend and are aligned to matingly correspond to and interface with the same groove.

In certain exemplary, non-limiting embodiments, the tray layer portion comprises a separate portion of material that is attached or coupled to the support layer portion.

In certain exemplary, non-limiting embodiments, the tray layer portion and the support layer portion are formed integral to one another to form a monolithic endcap element.

In various other exemplary, non-limiting embodiments, the packaging assembly comprises one or more corrugated corner elements, each of the corrugated corner elements extending, along a longitudinal axis, from a first end portion to a second end portion; each of the corrugated corner elements having a first corner post element leg, the first corner post element leg having one or more alternating ridges and grooves, each of the alternating ridges and grooves of the first corner post element leg extending along the longitudinal axis of each of the corrugated corner elements; each of the corrugated corner elements having a second corner post element leg, the second corner post element leg having one or more alternating ridges and grooves, each of the alternating ridges and grooves of the second corner post element leg extending along the longitudinal axis of each of the corrugated corner elements; two spaced apart endcap elements, wherein each endcap element comprises a support layer portion and a tray layer portion, wherein the support layer portion extends to four corners, and wherein the tray layer portion includes a corner recess formed proximate each corner of the support layer portion; and a support insert having a support insert body extending from a first end to a second end, wherein a void or gap is formed through a portion of the support insert body, extending from the first end to the second end, wherein a relief recess is formed within at least a portion of the support insert body, extending from the first end into at least a portion of the support insert body to allow at least a portion of one of the corrugated corner elements to be fitted within at least a portion of the relief recess, wherein a scalloped relief recess is formed within at least a portion of the support insert body, extending from the first end into at least a portion of the support insert body to allow at least a portion of one of the corrugated corner elements to be fitted within at least a portion of the scalloped relief recess, wherein one or more projections extend within a portion of the scalloped relief recess, from a lower wall portion of the scalloped relief recess toward the first end, wherein each of the one or more projections extends to interface with at least one of the grooves formed in the inner wall of the corrugated corner element.

In certain exemplary, non-limiting embodiments, each of the corrugated corner elements is formed to be at least partially flexed, to be positioned within a respective one of the corner recesses and wherein at least a portion of a first corner post element end of each of the corrugated corner elements and the second corner post element end of each of the corrugated corner elements are at least partially captured or frictionally engaged against end portions of each corner recess.

In various exemplary, non-limiting embodiments, the packaging assembly comprises two or more corrugated corner elements, wherein each of the corrugated corner elements includes an outer wall and an opposing inner wall, wherein each of the corrugated corner elements extends lengthwise, along a longitudinal axis, continuously from a first end portion to a second end portion, wherein each of the corrugated corner elements includes a first corner post element leg, wherein the first corner post element leg has one or more alternating ridges and grooves, wherein each of the alternating ridges and grooves extends along the longitudinal axis of each of the corrugated corner elements, wherein each of the corrugated corner elements includes a second corner post element leg, wherein the second corner post element leg has one or more alternating ridges and grooves, wherein each of the alternating ridges and grooves extends along the longitudinal axis of each of the corrugated corner elements, wherein the first corner post element leg and the second corner post element leg each extend from a vertex, and wherein each the vertex extends along the longitudinal axis of each of the corrugated corner elements; two spaced endcap elements, wherein each endcap element includes a support layer portion and a tray layer portion, wherein the support layer portion extends to two or more corners, wherein the tray layer portion includes a corner recess formed proximate each corner of the support layer portion, and wherein each of the corrugated corner elements is formed to be at least partially positioned within a respective one of the corner recesses; and a multi-slit support insert having a multi-slit support insert body extending substantially parallel a longitudinal axis of the multi-slit support insert, from a first terminal end to a second terminal end and extending substantially perpendicular to the longitudinal axis of the multi-slit support insert, from a first end to a second end, wherein one or more slits are formed at spaced apart locations along at least a portion of an outer side surface of the multi-slit support insert body, wherein each of the one or more slits is formed of a cut extending from a portion of an outer side surface of the multi-slit support insert body toward an inner side surface of the multi-slit support insert body, wherein each of the one or more slits leaves a remaining portion of the multi-slit support insert body defining a web proximate the inner side surface of the multi-slit support insert body, wherein at least a portion of the multi-slit support insert body is bent, along the longitudinal axis of the multi-slit support insert, such that the first terminal end is urged toward the second terminal end to allow at least a portion of the multi-slit support insert body to be fitted within at least a portion of the packaging assembly such that separate portions of the multi-slit support insert body contact at least a portion of the inner wall of two of the corrugated corner elements.

In certain exemplary, non-limiting embodiments, each of the one or more slits is formed so as to extend substantially perpendicular to the longitudinal axis of the multi-slit support insert body.

In certain exemplary, non-limiting embodiments, each web defined by each of the one or more slits provides a portion of the multi-slit support insert body that may be comparatively more easily bent.

In certain exemplary, non-limiting embodiments, each web defined by each of the one or more slits provides a reduced portion of the multi-slit support insert body, along which the multi-slit support insert body may be comparatively more easily bent.

In certain exemplary, non-limiting embodiments, the multi-slit support insert body is formed so as to have a substantially U-shaped cross-section and wherein end portions of the multi-slit support insert body extend away from one another, to form a pair of opposing, substantially planar, extension portions.

In certain exemplary, non-limiting embodiments, each of the one or more slits is formed equidistant from each adjacent one of the one or more slits.

In certain exemplary, non-limiting embodiments, a gap is formed between the first terminal end and the second terminal end of the multi-slit support insert body.

In certain exemplary, non-limiting embodiments, a portion of the first terminal end and a portion of the second terminal end each contact at least a portion of the inner wall of one of the corrugated corner elements.

In various exemplary, non-limiting embodiments, the packaging assembly comprises at least four corrugated corner elements, each of the corrugated corner elements having an outer wall and an opposing inner wall, each of the corrugated corner elements extending lengthwise, along a longitudinal axis, continuously from a first end portion to a second end portion, each of the corrugated corner elements having a first corner post element leg, the first corner post element leg having one or more alternating ridges and grooves, each of the alternating ridges and grooves extending along the longitudinal axis of each of the corrugated corner elements, each of the corrugated corner elements having a second corner post element leg, the second corner post element leg having one or more alternating ridges and grooves, each of the alternating ridges and grooves extending along the longitudinal axis of each of the corrugated corner elements, the first corner post element leg and the second corner post element leg each extending laterally from a vertex; two spaced endcap elements, each endcap element having a support layer portion and a tray layer portion, the support layer portion extending to four or more corners, the tray layer portion including a corner recess formed proximate each corner of the support layer portion, and each of the corrugated corner elements formed to be at least partially positioned within a respective one of the corner recesses, and a multi-slit support insert having a multi-slit support insert body extending substantially parallel a longitudinal axis of the multi-slit support insert, from a first terminal end to a second terminal end and extending substantially perpendicular to the longitudinal axis of the multi-slit support insert, from a first end to a second end, one or more slits being formed at spaced apart locations along at least a portion of an outer side surface of the multi-slit support insert body, each of the one or more slits being formed of a cut extending from a portion of an outer side surface of the multi-slit support insert body toward an inner side surface of the multi-slit support insert body, each of the one or more slits leaving a remaining portion of the multi-slit support insert body defining a web proximate the inner side surface of the multi-slit support insert body, at least a portion of the multi-slit support insert body being bent such that the first terminal end is urged toward the second terminal end to allow at least a portion of the multi-slit support insert body to be fitted within at least a portion of the packaging assembly such that separate portions of the multi-slit support insert body contact at least a portion of the inner wall of two of the corrugated corner elements.

In various exemplary, non-limiting embodiments, the packaging assembly comprises at least four corrugated corner elements, wherein each of the corrugated corner elements includes an outer wall and an opposing inner wall, wherein each of the corrugated corner elements extends lengthwise, along a longitudinal axis, from a first end portion to a second end portion, wherein each of the corrugated corner elements includes a first corner post element leg, wherein the first corner post element leg includes one or more alternating ridges and grooves, wherein each of the alternating ridges and grooves extends along the longitudinal axis of each of the corrugated corner elements, wherein each of the corrugated corner elements includes a second corner post element leg, wherein the second corner post element leg includes one or more alternating ridges and grooves, wherein each of the alternating ridges and grooves extends along the longitudinal axis of each of the corrugated corner elements, wherein the first corner post element leg and the second corner post element leg each extend from a vertex; two spaced endcap elements, wherein each endcap element includes a support layer portion and a tray layer portion, wherein the support layer portion extends to four or more corners, wherein the tray layer portion includes a corner recess formed proximate each corner of the support layer portion, and wherein each of the corrugated corner elements is formed to be at least partially positioned within a respective one of the corner recesses; and a multi-slit support insert having a multi-slit support insert body extending from a first terminal end to a second terminal end and extending from a first end to a second end, wherein one or more slits are formed at spaced apart locations along at least a portion of an outer side surface of the multi-slit support insert body, wherein each of the one or more slits is formed of a cut extending from a portion of an outer side surface of the multi-slit support insert body toward an inner side surface of the multi-slit support insert body, wherein each of the one or more slits leaves a remaining portion of the multi-slit support insert body defining a web proximate the inner side surface of the multi-slit support insert body, wherein at least a portion of the multi-slit support insert body is bent such that the first terminal end is urged toward the second terminal end to allow at least a portion of the multi-slit support insert body to be fitted within at least a portion of the packaging assembly such that separate portions of the multi-slit support insert body contact at least a portion of the inner wall of two of the corrugated corner elements.

Accordingly, the present disclosure provides a support insert having a scalloped relief recess for a corrugated corner elements.

The present disclosure separately and optionally provides a packaging assembly with door support insert that can be easily stored in a relatively compact configuration, awaiting assembly and use.

The present disclosure separately and optionally provides a packaging assembly with door support insert that can be easily assembled or constructed, when needed.

The present disclosure separately and optionally provides a packaging assembly with door support insert that provides increased protection to various portions of an article or product, such as, for example, a door of a front loading laundry washer or dryer.

The present disclosure separately and optionally provides a packaging assembly with door support insert that provides lower costs for handling and storage.

The present disclosure separately and optionally provides a packaging assembly with door support insert with a high degree of compressional strength.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein. However, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE INVENTION

Figure 1:
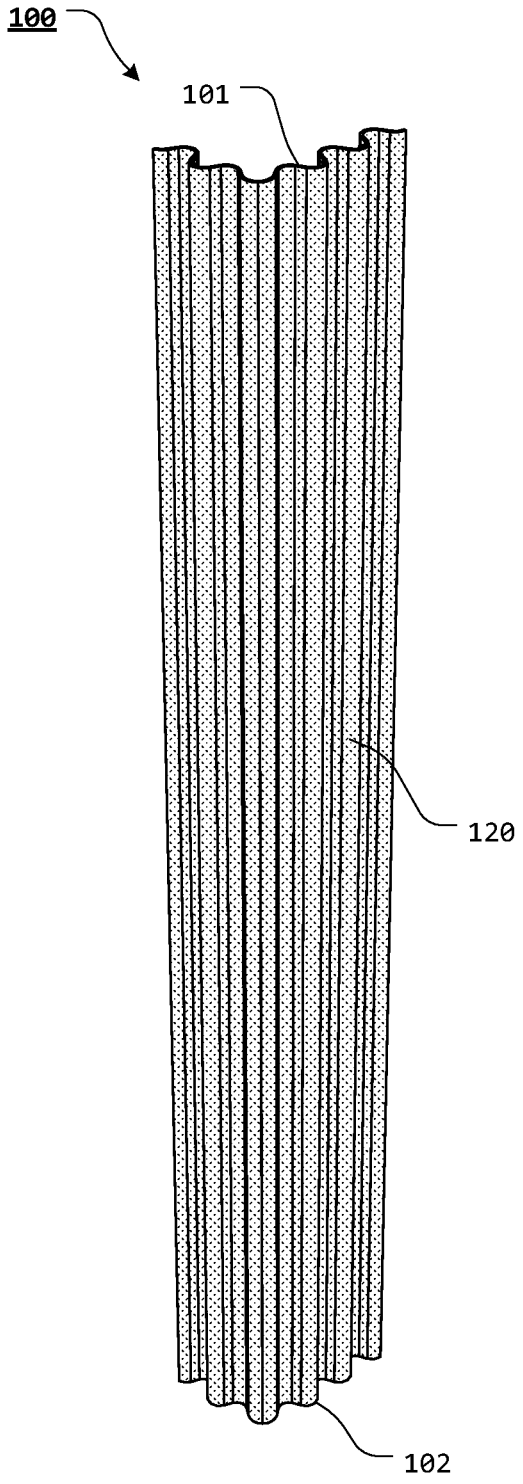
FIG. 1 illustrates a front perspective view of an exemplary embodiment of a corrugated corner element, according to the present disclosure.
Figure 2:
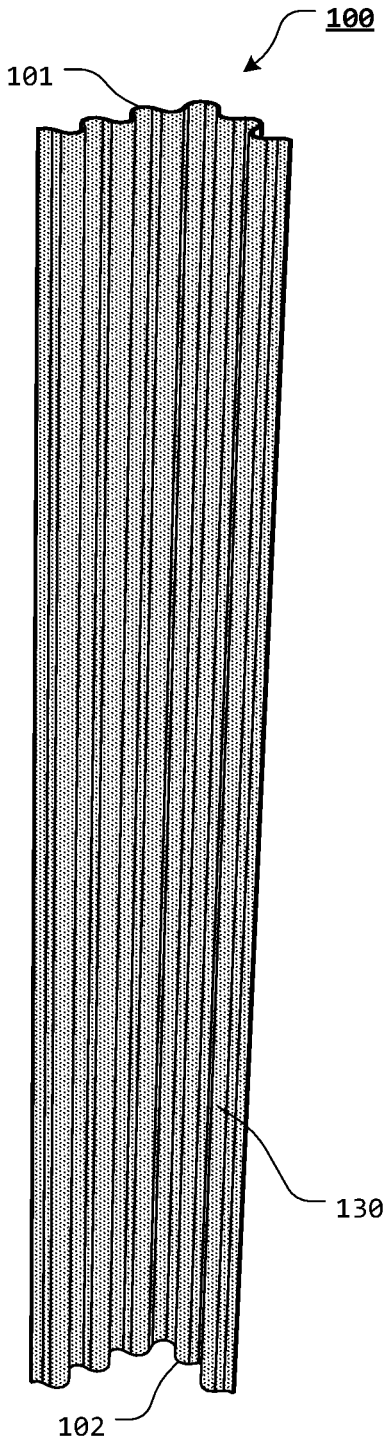
FIG. 2 illustrates a rear perspective view of an exemplary embodiment of a corrugated corner element, according to the present disclosure.
Figure 3:
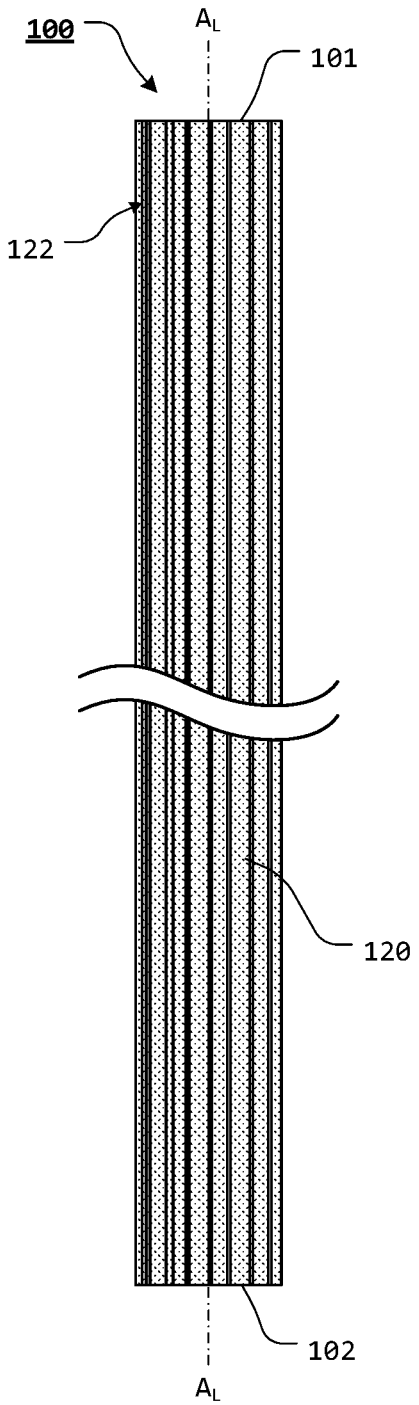
FIG. 3 illustrates a right side view of an exemplary embodiment of a corrugated corner element, according to the present disclosure.
Figure 4:
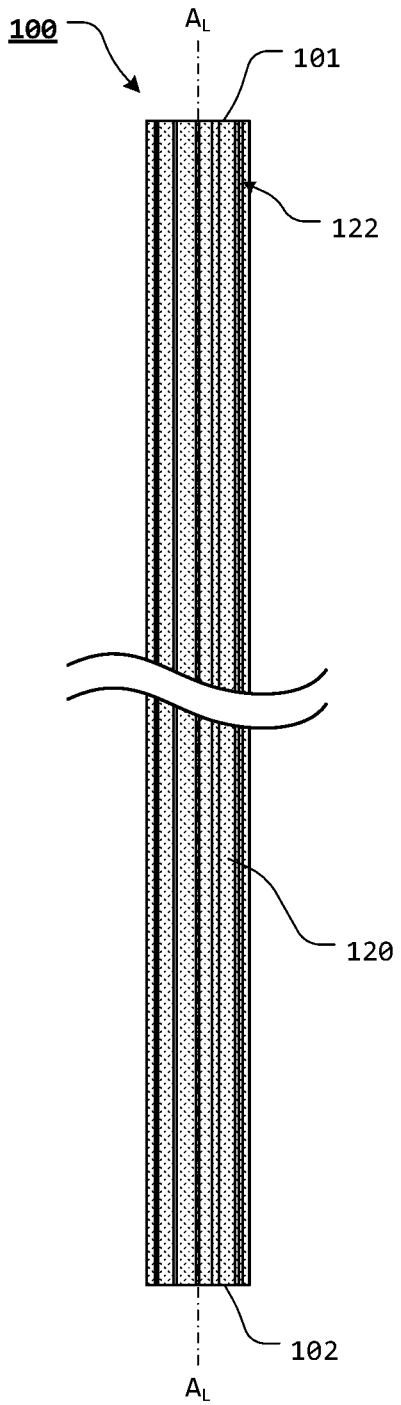
FIG. 4 illustrates a left side view of an exemplary embodiment of a corrugated corner element, according to the present disclosure.

For simplicity and clarification, the design factors and operating principles of the packaging assembly with door support insert are explained with reference to various exemplary embodiments of a packaging assembly with door support insert according to the present disclosure. The basic explanation of the design factors and operating principles of the packaging assembly with door support insert is applicable for the understanding, design, and operation of the packaging assembly with door support insert of the present disclosure. It should be appreciated that the packaging assembly with door support insert can be adapted to many applications where a packaging assembly can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "packaging assembly" and "corrugated corner element" are used for basic explanation and understanding of the operation of the systems, methods, and apparatuses of the present disclosure. Therefore, the terms "packaging assembly" and "corrugated corner element" are not to be construed as limiting the systems, methods, and apparatuses of the present disclosure.

Turning now to the appended drawing figures, FIGS. 1-32 illustrate certain elements and/or aspects of an exemplary embodiment of the packaging assembly 10 with corrugated corner elements 100, two endcap elements 200, and a support insert 300, according to the present disclosure. In illustrative, non-limiting embodiment(s) of the present disclosure, as illustrated in FIGS. 1-32, the packaging assembly 10 comprises a plurality of corrugated corner elements 100, typically two endcap elements 200, and a support insert 300.

As illustrated most clearly in FIGS. 1-6, the corrugated corner element 100 comprises an elongate portion of material that extends, along a longitudinal axis, $A_L$, from a first end portion 101 to a second end portion 102. In various exemplary embodiments, the corrugated corner element 100 extends continuously, in an uninterrupted manner, from the first end portion 101 to the second end portion 102. Alternatively, one or more notches or recesses may optionally be formed in one or more areas, along the corrugated corner element 100, between the first end portion 101 and the second end portion 102.

A vertex 122 is defined along the corrugated corner elements 100. The vertex 122 generally extends, along the longitudinal axis, $A_L$, from the first end portion 101 to the second end portion 102. The vertex 122 defines a line from which the first corner post element leg 110 and the second corner post element leg 112 extend. In certain exemplary, non-limiting embodiments, the vertex 122 bisects the corrugated corner elements 100, along the longitudinal axis, $A_L$, proximate a center of each of the corrugated corner elements 100. Generally, the vertex 122 defines the furthest extent of the corrugated corner element 100.

The first corner post element leg 110 extends laterally, away from the vertex 122 to a first corner post element end 128, while the second corner post element leg 112 extends laterally, away from the vertex 122 to a second corner post element end 129. The second corner post element end 129 extends laterally from the vertex 122, in a direction that is generally away from the direction that the first corner post element end 128 extends laterally from the vertex 122.

In certain exemplary, nonlimiting embodiments, substantially straight lines from the vertex 122 to the respective first corner post element end 128 and from the vertex 122 to the second corner post element end 129 are at approximately 90° relative to one another.

Figure 5:
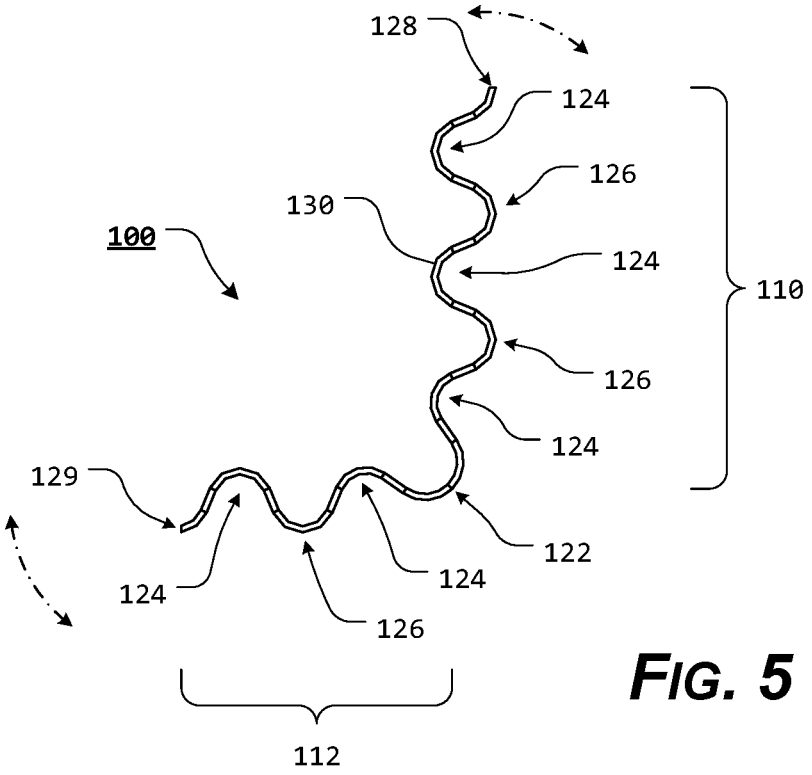
FIG. 5 illustrates a top view of an exemplary embodiment of a corrugated corner element, according to the present disclosure.
Figure 6:
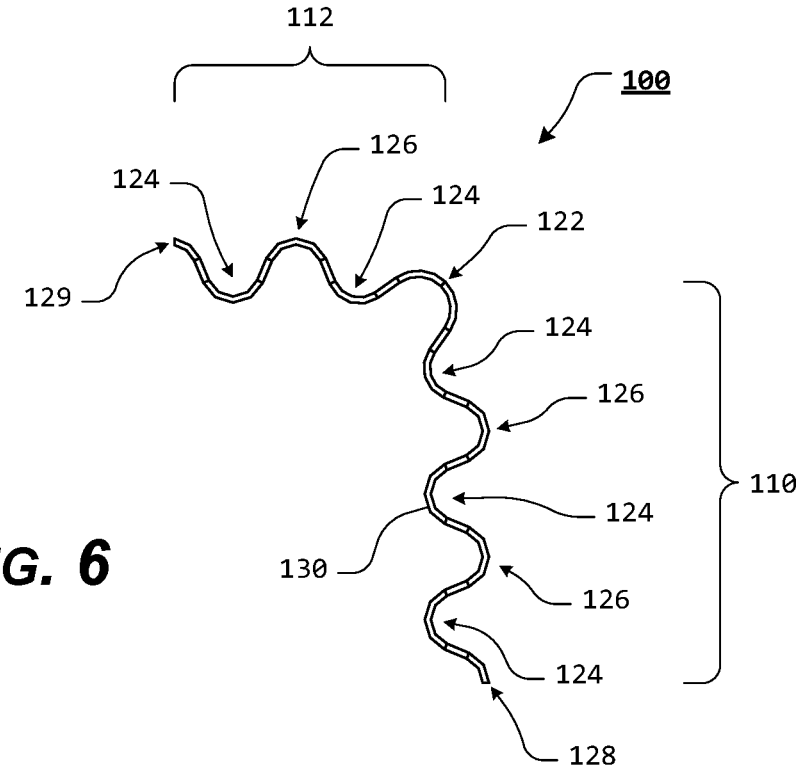
FIG. 6 illustrates a bottom view of an exemplary embodiment of a corrugated corner element, according to the present disclosure.
Figure 7:
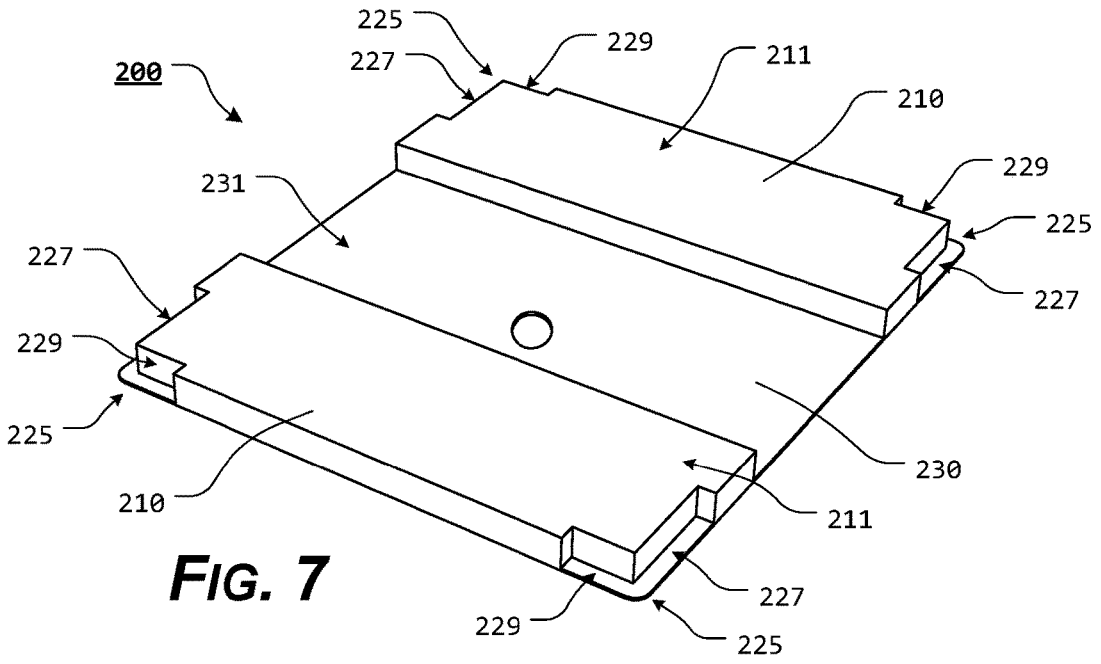
FIG. 7 illustrates an upper, perspective view of an exemplary embodiment of an endcap element, according to the present disclosure.
Figure 8:
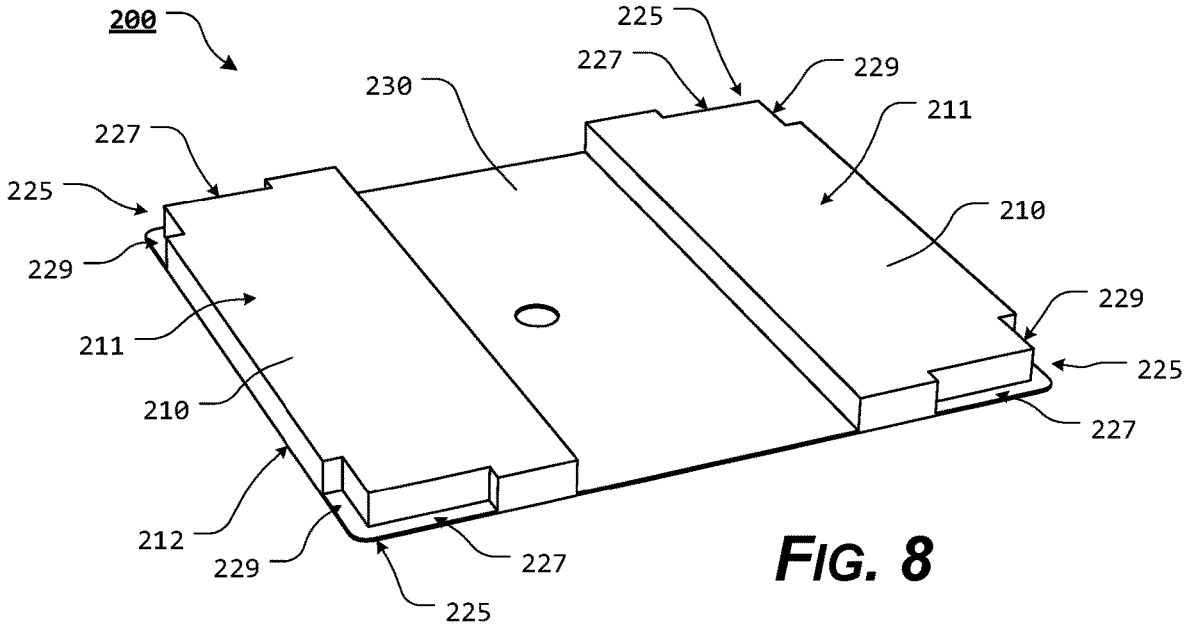
FIG. 8 illustrates an upper, perspective view of an exemplary embodiment of an endcap element, according to the present disclosure.
Figure 9:
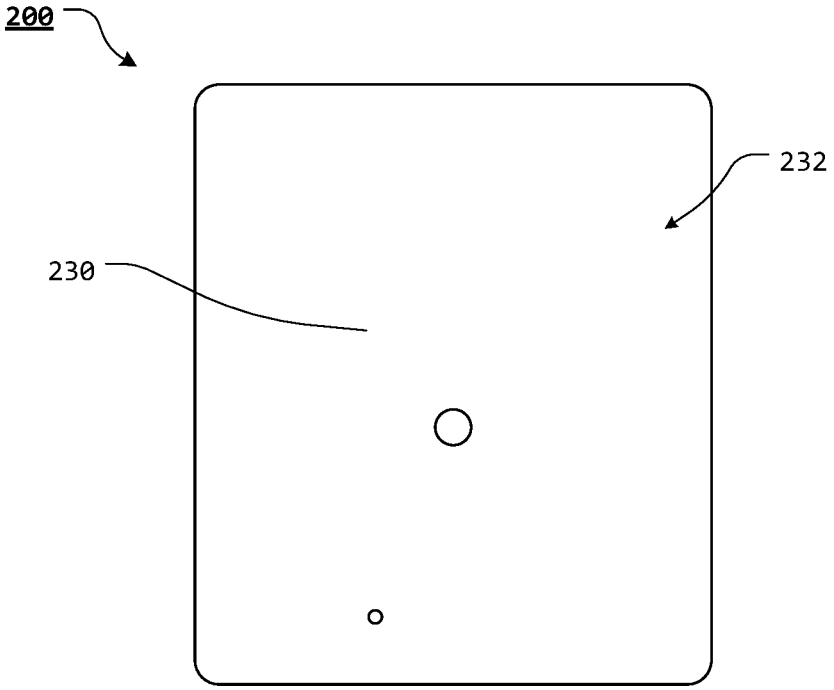
FIG. 9 illustrates a bottom view of an exemplary embodiment of an endcap element, according to the present disclosure.
Figure 10:
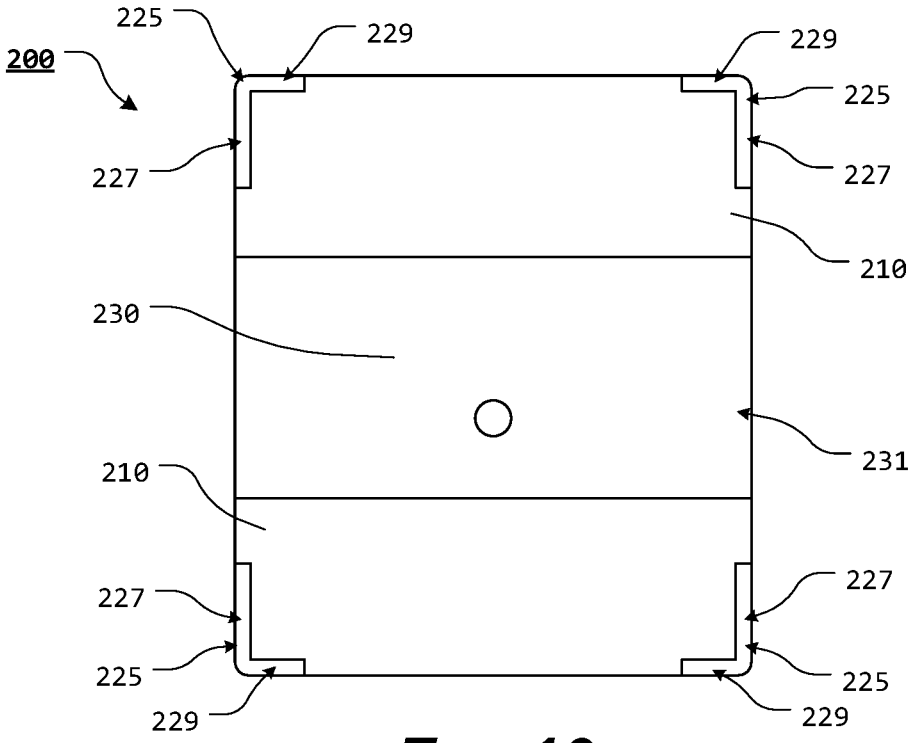
FIG. 10 illustrates a top view of an exemplary embodiment of an endcap element, according to the present disclosure.
Figure 11:
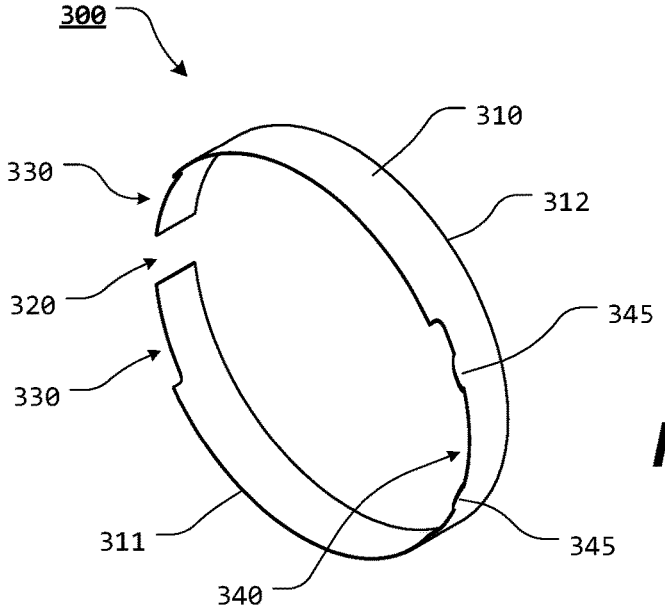
FIG. 11 illustrates an upper, perspective view of an exemplary embodiment of support insert, according to the present disclosure.
Figure 12:
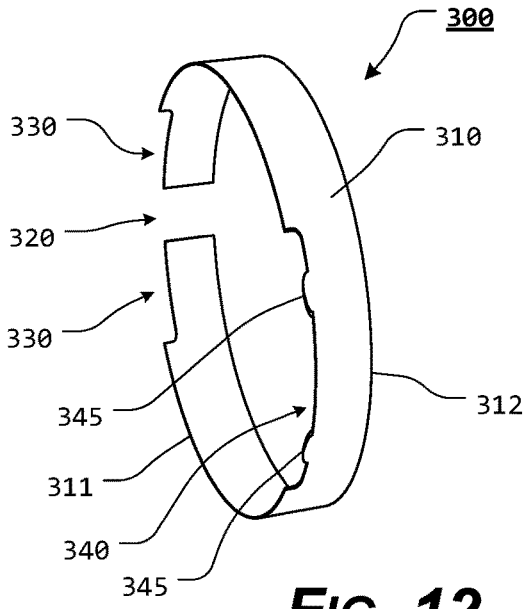
FIG. 12 illustrates an upper, front perspective view of an exemplary embodiment of support insert, according to the present disclosure.
Figure 13:
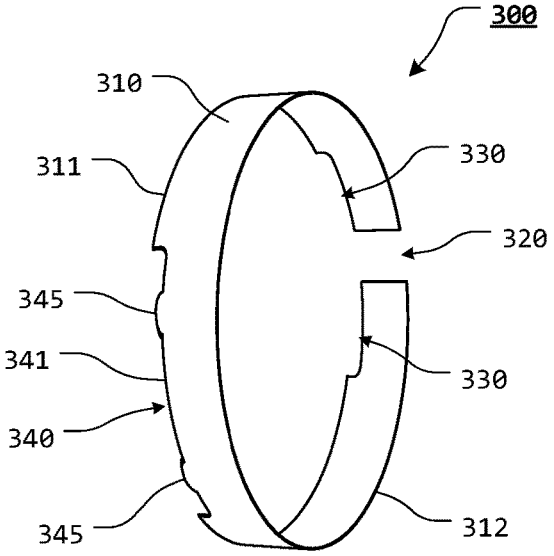
FIG. 13 illustrates an upper, rear perspective view of an exemplary embodiment of support insert, according to the present disclosure.
Figure 14:
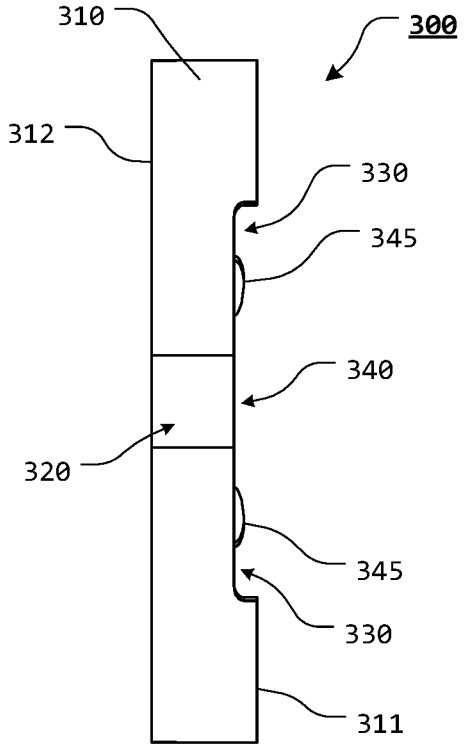
FIG. 14 illustrates a left side view of an exemplary embodiment of support insert, according to the present disclosure.
Figure 15:
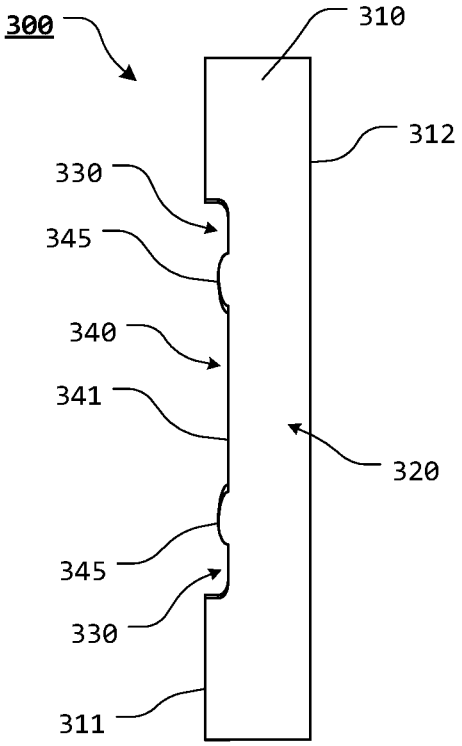
FIG. 15 illustrates a right side view of an exemplary embodiment of support insert, according to the present disclosure.

Typically, when viewed from the top or the bottom, as illustrated in FIGS. 5 and 6, respectively, the first corner post element leg 110 includes one or more alternating ridges 126 and grooves 124, formed along its length. Likewise, the second corner post element leg 112 includes one or more alternating ridges 126 and/or grooves 124, along its length. Each of the alternating ridges 126 and grooves 124 of the first corner post element leg 110 extends, along or parallel to the longitudinal axis, $A_L$, of the corrugated corner elements 100. In certain exemplary, nonlimiting embodiments, each of the alternating ridges 126 and grooves 124 are parallel.

By including the alternating ridges 126 and grooves 124, the first corner post element leg 110 and the second corner post element leg 112 is curvilinear along its respective length, from the vertex 122 to the respective first corner post element end 128 and from the vertex 122 to the second corner post element end 129. The alternating ridges 126 and grooves 124 may be formed such that the first corner post element leg 110 and the second corner post element leg 112 each comprise a sinusoidal succession of waves or curves, along the respective lengths, from the vertex 122 to the respective first corner post element end 128 and from the vertex 122 to the second corner post element end 129.

Generally, each ridge 126, formed in or along the outer wall 120 corresponds to a groove 124 formed in or along the inner wall 130.

As illustrated, a transverse cross-section of the second corner post element leg 112 initially forms a mirror image of a transverse cross-section of the first corner post element leg 110. However, it should be appreciated that it is not necessary for the transverse cross-section of the second corner post element leg 112 to form a mirror image of a transverse cross-section of the first corner post element leg 110. Thus, a transverse cross-section of the second corner post element leg 112 may have alternating ridges 126 and grooves 124 that are not mirror images of the alternating ridges 126 and grooves 124 of a transverse cross-section of the first corner post element leg 110.

As illustrated, the first corner post element leg 110 is longer than the second corner post element leg 112, as measured from the vertex 122 to the first corner post element and 128 and from the vertex 122 to the second corner post element and 129, respectively. However, it should be appreciated that the length of the first corner post element leg 110 may be greater than, equal to, or less than the length of the second corner post element leg 112. Thus, it should be appreciated that the length of the first corner post element leg 110 and the second corner post element leg 112 is a design choice.

The outer wall 120 forms an exterior surface of the corrugated corner element 100, while an inner wall 130 forms and interior surface of the corrugated corner element 100. As used herein, the terms "exterior" and "interior" are used for reference only and are not to be viewed as limiting the present disclosure. In certain exemplary, non-limiting embodiments, the outer wall 120 of the corrugated corner element 100 is substantially coextensive with the inner wall 130 of the corrugated corner element 100.

Because of the inclusion of the alternating ridges 126 and grooves 124, the corrugated corner element 100 is better able to resist top to bottom compression, parallel to or along the longitudinal axis, $A_L$, of the corrugated corner elements 100. Additionally, the inclusion of the alternating ridges 126 and grooves 124 helps the first corner post element leg 110 and the second corner post element leg 112 to better resist crushing, when forces are applied to the outer wall 120 and/or the inner wall 130.

In various exemplary embodiments, the vertex 122 and optionally the alternating ridges 126 and grooves 124 allow for a degree of inward flexion and resilient recovery toward the original shape of the first corner post element leg 110 relative to the second corner post element leg 112, as illustrated by the semicircular arrows in FIG. 5.

In various exemplary embodiments, each corrugated corner element 100 is substantially rigid and is formed of cardboard. Alternate materials of construction of the corrugated corner element 100 may include one or more of the following: thick paper (of various types), pasteboard, paperboard, container board, corrugated fiberboard, box board, or chipboard. In still other exemplary embodiments, alternate materials of construction of the corrugated corner element 100 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the corrugated corner element 100 is a design choice based on the desired appearance and functionality of the corrugated corner element 100 and/or the packaging assembly 10.

In certain exemplary embodiments, the endcap element 200 extends to four corners and comprises at least one support layer portion 230. The support layer portion 230 includes an elongate portion of material having a top surface 231 and a bottom surface 232. However, it should be understood that the number of corners of the endcap element 200 is a design choice, dictated primarily by an upper or lower footprint of an article or product 400 that is to be contained or packaged within the packaging assembly 10.

In certain exemplary, nonlimiting embodiments, each endcap element 200 comprises at least one partial tray layer portion 210 and at least one support layer portion 230. Each partial tray layer portion 210 includes an elongate portion of material having a top surface 211. Typically, the top surface 211 extends above at least a portion of the top surface 231 of the at least one support layer portion 230.

In various exemplary embodiments, the at least one partial tray layer portion 210 is formed as an interval component of the at least one support layer portion 230. Alternatively, the at least one partial tray layer portion 210 is formed of a separate component and includes a bottom surface 212. In these exemplary embodiments, the bottom surface 212 of the at least one partial tray layer portion 210 is attached or coupled to at least a portion of the top surface 231 of the at least one support layer portion 230.

In various exemplary embodiments, adjacent surfaces of the partial tray layer portion 210 and/or the support layer portion 230 may optionally be bonded together, such as, by adhesives, forming adhesive layers. Alternatively, portions of the partial tray layer portion 210 and/or support layer portion 230 may optionally be attached, coupled, fastened, or secured to one another, mechanically (i.e., via nails, screws, rivets, pins, or other fasteners) or as otherwise known in the art.

It should also be appreciated that certain indents or recesses may be formed in at least portions of the partial tray layer portion 210 and/or the support layer portion 230 to accommodate and/or further secure an article or product 400 within the packaging assembly 10.

A corner recess 225 is formed in a portion of the at least one partial tray layer portion 210. Each corner recess 225 is formed proximate each corner of the at least one partial tray layer portion 210. In this manner, corner portions of at least the support layer portion 230 extend beyond the corner recesses 225 formed in the partial tray layer portion(s) 210.

Each corner recess 225 includes a first corner post recess portion 227 and a second corner post recess portion 229. Generally, each corner post recess 225 is formed to receive at least a portion of the corrugated corner elements 100 at least partially therein. More specifically, each first corner post recess portion 227 is formed to allow at least a portion of the first end portion 101 of one of the corrugated corner elements 100 at least partially therein. Similarly, each second corner post recess portion 229 is formed to matingly engage at least a portion of the second end portion 102 of one of the corrugated corner elements 100 at least partially therein.

Generally, each corner recess 225 is formed to substantially abut at least a portion of the inner wall 130 of at least a first end portion 101 or a second end portion 102 of each of the corrugated corner elements 100.

In various exemplary embodiments, the endcap element 200 is substantially rigid and is formed of cardboard. Alternate materials of construction of the endcap element 200 may include one or more of the following: thick paper (of various types), pasteboard, paperboard, container board, corrugated fiberboard, box board, or chipboard. In still other exemplary embodiments, alternate materials of construction of the endcap element 200 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the endcap element 200 is a design choice based on the desired appearance and functionality of the endcap element 200 and/or the packaging assembly 10.

It should be appreciated that certain elements of the endcap element 200 may be formed as an integral unit. Alternatively, suitable materials can be used and sections or elements made independently (such as, for example, the partial tray layer portion 210 and the support layer portion 230) and attached or coupled together, such as by adhesives, welding, screws, rivets, pins, or other fasteners, to form the various elements of the endcap element 200.

Figure 16:
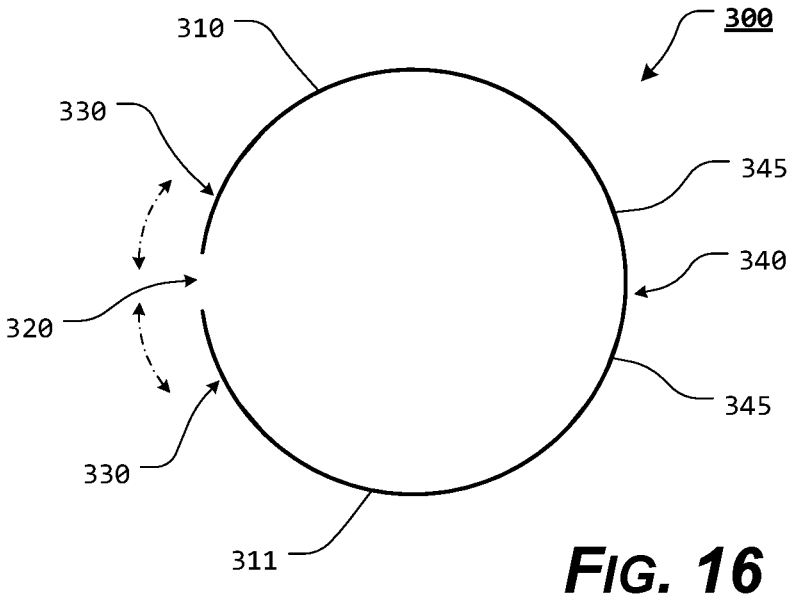
FIG. 16 illustrates a front view of an exemplary embodiment of support insert, according to the present disclosure.
Figure 17:
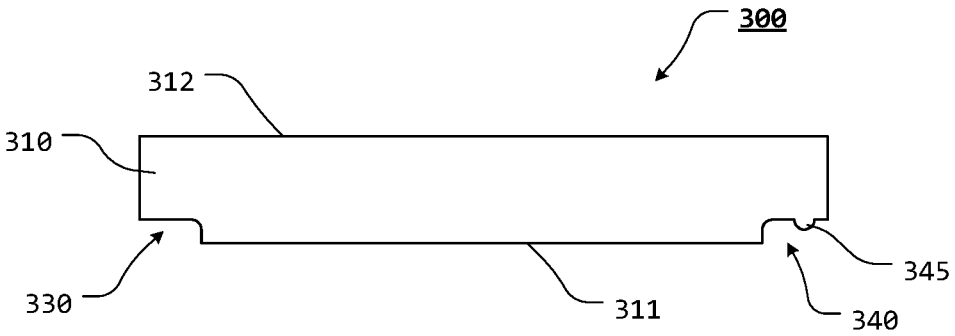
FIG. 17 illustrates a top view of an exemplary embodiment of support insert, according to the present disclosure.

As illustrated most clearly in FIGS. 11-17, the support insert 300 includes a support insert body 310 extending from a first end 311 to a second end 312. In various exemplary embodiments, the support insert body 310 forms a partial cylinder, having a substantially circular cross-sectional view, when viewed from the first end 311, as illustrated in FIG. 16.

In various exemplary embodiments, the support insert 300 is formed of a portion of corrugated or pleated fiberboard or cardboard.

In various exemplary embodiments, an optional void or gap 320 is formed through a portion of the support insert body 310. If included, the void or gap 320 allows for a degree of inward and/or outward flexion of the support insert body 310, as illustrated by the semicircular arrows in FIG. 16. By providing a degree of inward and/or outward flex station of the support insert body 110, the support insert 300 can be expanded or contracted to be appropriately fitted within at least a portion of an article or product 400. For example, the support insert body 310 may be flexed to be appropriately fitted within at least a portion of a door 410 of a front loading laundry washer or dryer article or product 400.

In certain exemplary embodiments, the void or gap 320 is formed within the support insert body 310 to allow a portion of the article or product 400, such as, for example, a hinge, door pole, or the like, to be at least partially fitted within the void gap 320.

A relief recess 330 is formed within at least a portion of the support insert body 310. The relief recess 330 extends from the first end 311, into at least a portion of the support insert body 310. The relief recess 330 generally extends on either side of the void or gap 320. The relief recess 330 is formed to allow at least a portion of a corrugated corner element 100 (or a non-corrugated corner post) to be fitted within at least a portion of the relief recess 330.

A scalloped relief recess 340 is also formed within at least a portion of the support insert body 310. The scalloped relief recess 340 extends from the first end 311, into at least a portion of the support insert body 310. Generally, the scalloped relief recess 340 is formed substantially opposite the relief recess 330 (substantially 180° from the relief recess 330) and is formed to allow at least a portion of a corrugated corner element 100 to be fitted within at least a portion of the scalloped relief recess 340.

One or more projections 345 extend within the scalloped relief recess 340, from a lower wall portion 341 of the scalloped relief recess 340 toward the first end 311. The one or more projections 345 each extend to matingly correspond to and interface with at least one of the grooves 124 formed in the inner wall 130 of the corrugated corner element 100 (as illustrated most clearly in FIG. 23). In various exemplary embodiments, two or more projections 345 extend within the scalloped relief recess 340. In these exemplary embodiments, the two or more projections 345 extend and are aligned to matingly correspond to and interface with the same groove 124, when appropriately aligned with a corrugated corner element 100.

In this manner, the support insert 300 may be aligned with a corrugated corner element 100 to be slidably positioned parallel to or along the longitudinal axis, $A_L$, of the corrugated corner element 100. However, interaction between the one or more projections 345 and the aligned the groove 124 resists movement of the support insert 300 perpendicular to the corrugated corner element 100.

If the relief recess 330 does not include any projections, when the support insert 300 is aligned with a corrugated corner element 100, the support insert 300 is slidable or otherwise movable along the longitudinal axis, $A_L$, and perpendicular to the longitudinal axis, $A_L$, of the corrugated corner element 100.

Figure 28:
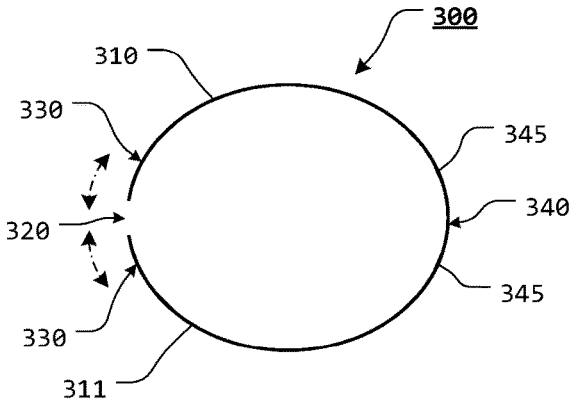
FIG. 28 illustrates a front view of an exemplary embodiment of a support insert, according to the present disclosure.
Figure 29:
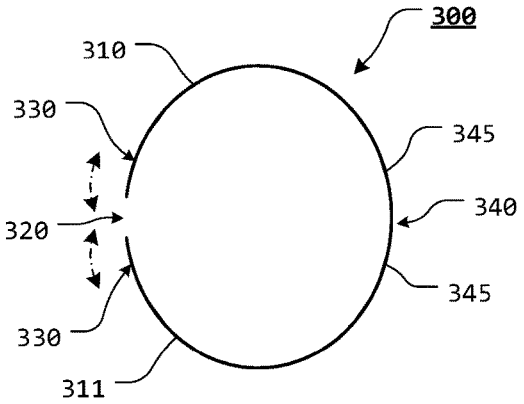
FIG. 29 illustrates a front view of an exemplary embodiment of a support insert, according to the present disclosure.
Figure 30:
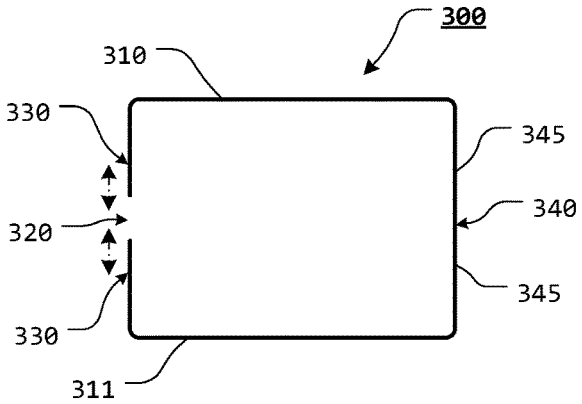
FIG. 30 illustrates a front view of an exemplary embodiment of a support insert, according to the present disclosure.
Figure 31:
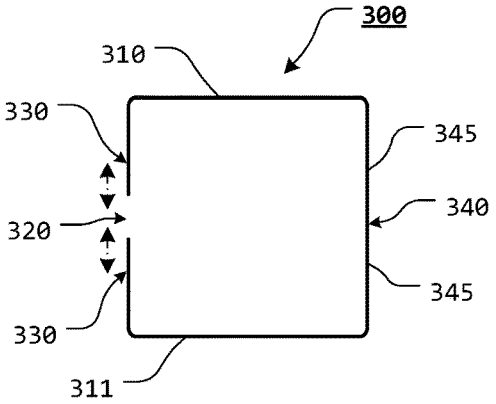
FIG. 31 illustrates a front view of an exemplary embodiment of a support insert, according to the present disclosure.

While the support insert 300 is initially illustrated as forming a partial cylinder, having a substantially circular cross-sectional view, it should be appreciated that the support insert 300 is not so limited. Thus, for example, the support insert 300 may generally be formed in the shape of an oval (as illustrated in FIGS. 28-29), a triangle, a rectangle (as illustrated in FIG. 30), a square (as illustrated in FIG. 31), a pentagon, a hexagon, a heptagon, an octagon, a nanogon, a decagon, a pentadecagon, an icosagon, or any other desired shape or configuration. Thus, it should be appreciated that the size and shape of each of the support insert 300 is a design choice based upon the size and/or shape of a door or other feature of the article or product 400 with which the support insert 300 and/or the packaging assembly 10 is to be utilized.

Figure 32:
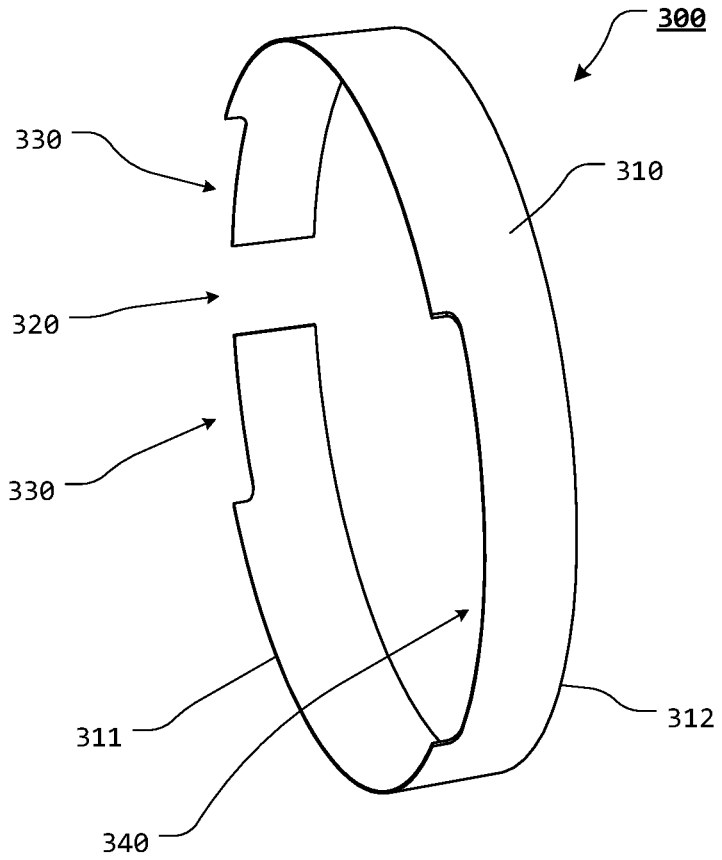
FIG. 32 illustrates an upper, front, right perspective view of an exemplary embodiment of a support insert, according to the present disclosure.

Additionally, while the support insert 300 is shown and described as including one or more projections 345 extending within at least a portion of the scalloped relief recess 340, it should be appreciated that in certain exemplary embodiments, as illustrated in FIG. 32, the one or more projections 345 are not included and the scalloped relief recess 340 is formed to be substantially similar to the relief recess 330.

Assembly of the packaging assembly 10 is illustrated in FIGS. 18-21, using an exemplary article or product 400 having a door 410, while the packaging assembly 10 is illustrated in FIGS. 22-37, as being assembled without an exemplary article or product 400, for ease of reference.

While the article or product 400 is illustrated as being a front loading laundry washer or dryer, it should be appreciated that the article or product 400 may be any desired appliance, article, or product to be packaged for shipping.

In certain exemplary, nonlimiting embodiments, the endcap elements 200 may be constructed having an International Organization for Standardization (ISO) sanctioned pallet dimension (i.e., 40.00"x48.00", 39.37"x47.24", 45.9"x45.9", 42.00"x42.00", 43.30"x43.30", or 31.50"x47.24"), a Grocery Manufacturers' Association (GMA) pallet dimension (i.e., 40"x48", 42"x42", 48"x48", 48"x40", 48"x42", 40"x40", 48"x45", 44"x44", 36"x36", 48"x36", 35"x45.5", or 48"x20"), a European pallet dimension (i.e., 31.50"x47.24", 47.24"x39.37", 39.37"x47.24", 31.50"x23.62", 23.62"x15.75", or 15.75"x11.81"), an Australian pallet dimension (i.e., 45.87"x45.87"), or any desired size or shape. It should also be understood that the overall size and shape of the endcap elements 200 (and the resulting packaging assembly 10), and the various portions thereof, is a design choice based upon the desired functionality, compatibility with desired articles or products, and/or appearance of the packaging assembly 10.

In certain exemplary, nonlimiting embodiments, at least a portion of the bottom surface 232 of the first endcap element 200 may be textured to provide a surface having a desired degree of friction relative to a floor or other support surface. Thus, the bottom surface 232 of the first endcap element 200 (or a bottom surface 232, serving as a top surface of the second endcap element 200) may be chosen to allow the packaging assembly 10 to resist movement relative to a floor or other surface or more easily slide across a floor or other surface.

Figure 18:
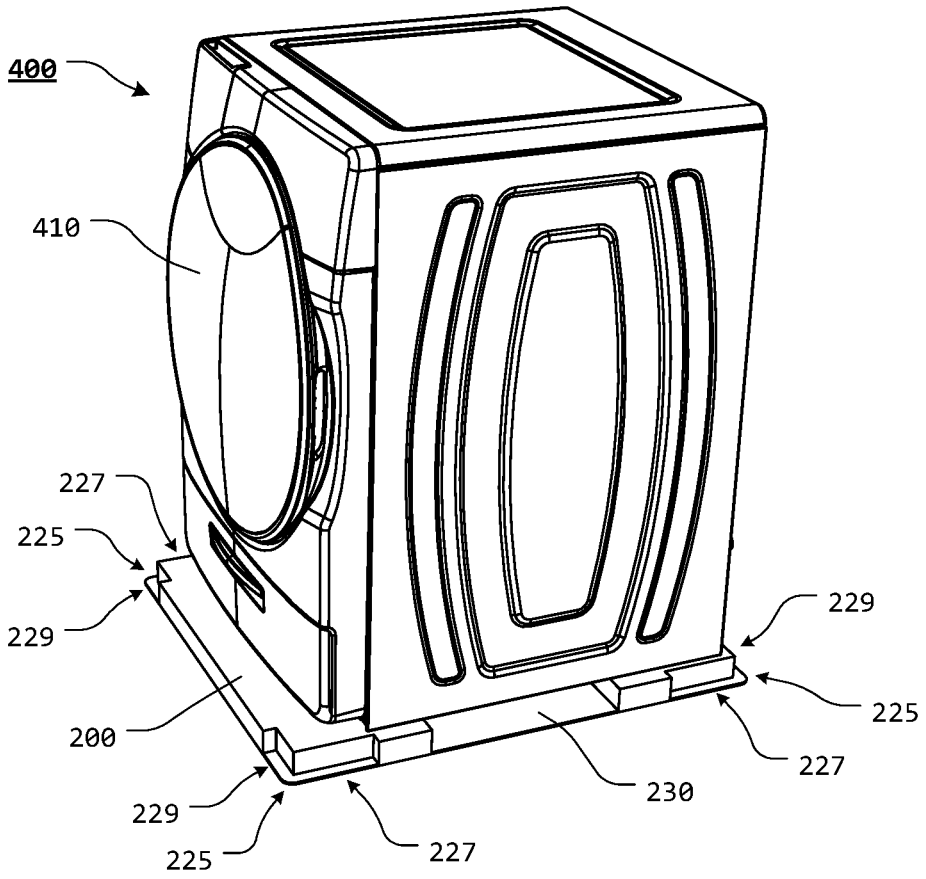
FIG. 18 illustrates an upper, perspective view of an exemplary article or product positioned atop an exemplary embodiment of an endcap element, according to the present disclosure.

During an exemplary assembly of the packaging assembly 10, a first endcap element 200 is positioned generally below an article or product 400, as illustrated in FIG. 18. A second endcap element 200 is positioned generally a top the article or product 400, as illustrated in FIG. 19.

When properly positioned, a corner portion of each of the endcap elements 200 extends beyond at least a portion of the article or product 400. In various exemplary embodiments, the corner recesses 225 are formed to generally allow the corrugated corner elements 100 to be aligned with the corners of the support layer portion 230.

Figure 19:
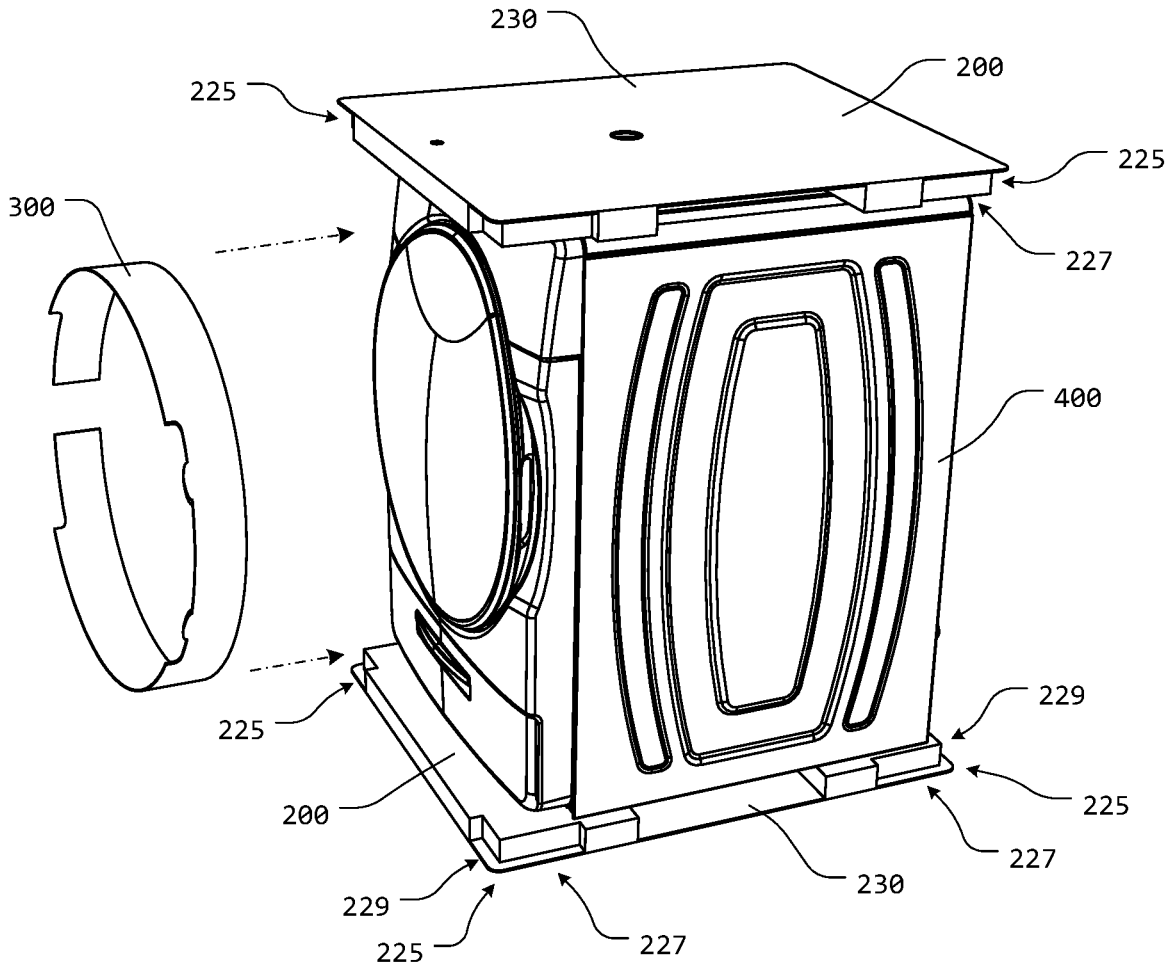
FIG. 19 illustrates an upper, perspective view of one or more exemplary components of an exemplary embodiment of a packaging assembly being aligned and/or assembled, according to the present disclosure.

As further illustrated in FIG. 19, the support insert 300 is aligned with and fitted around, against, or within at least a portion of a portion of the door 410 of the article or product 400. In various exemplary embodiments, the support insert body 310 may be flexed to be appropriately fitted around, against, or within at least a portion of a door 410 of the article or product 400.

Figure 20:
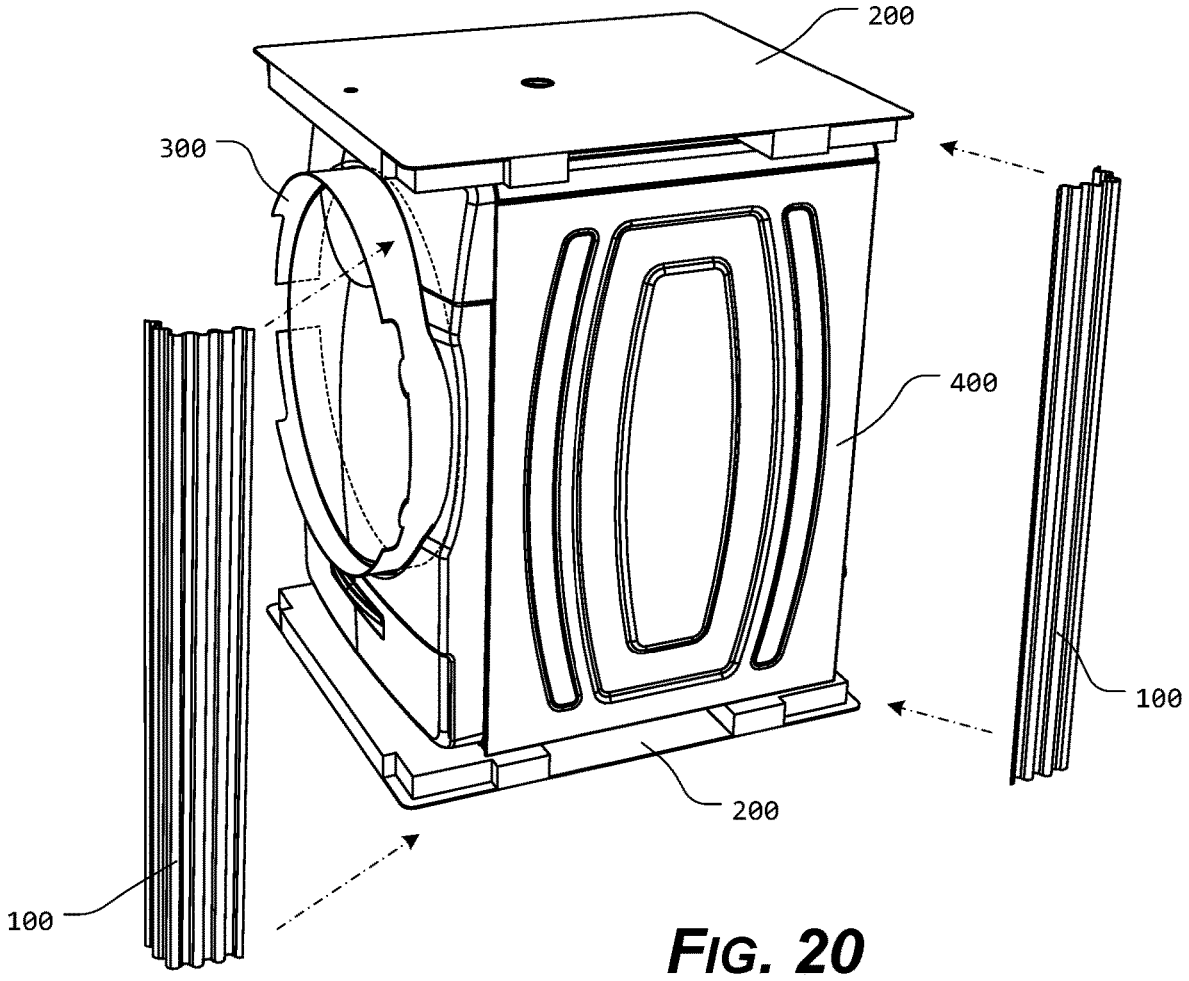
FIG. 20 illustrates an upper, perspective view of one or more exemplary components of an exemplary embodiment of a packaging assembly being aligned and/or assembled, according to the present disclosure.
Figure 21:
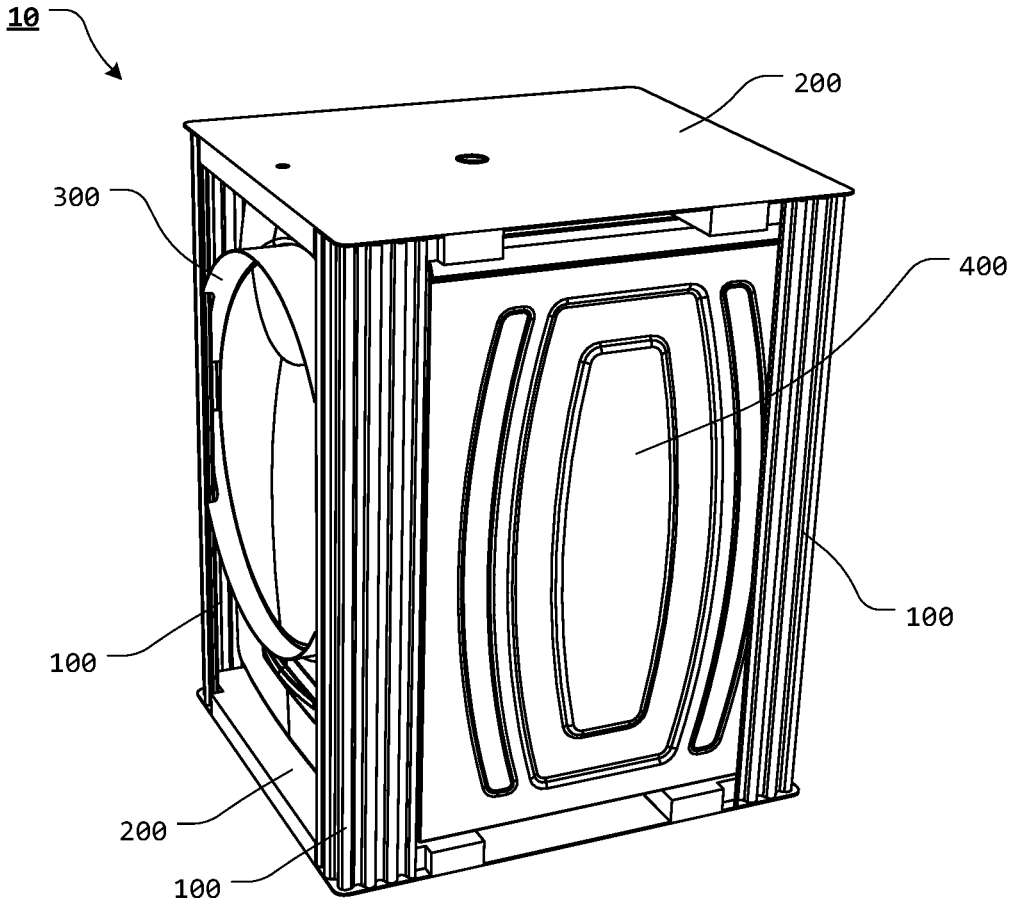
FIG. 21 illustrates an upper, perspective view of one or more exemplary components of an exemplary embodiment of an assembled packaging assembly, according to the present disclosure.
Figure 22:
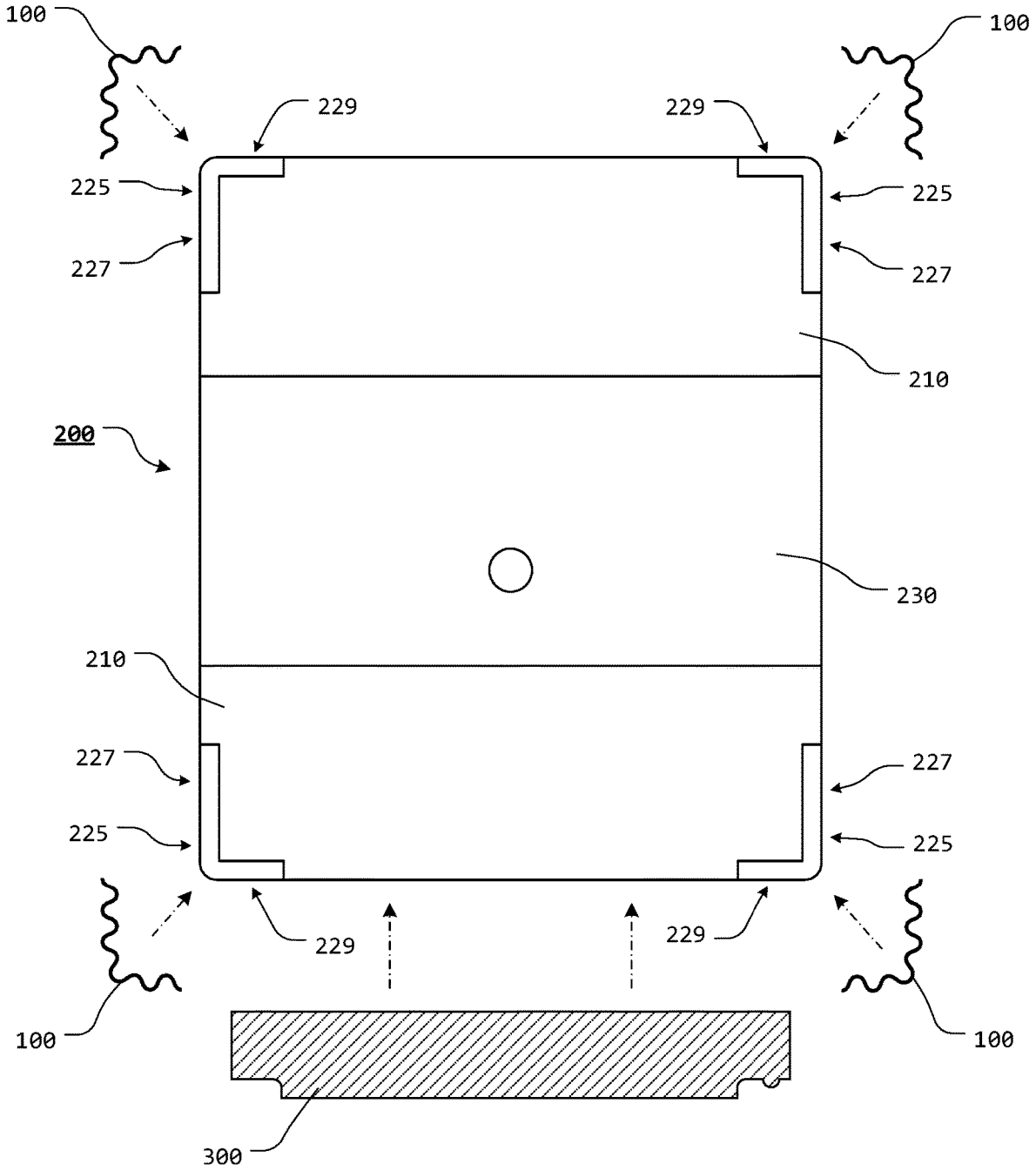
FIG. 22 illustrates a top view of one or more exemplary components of an exemplary embodiment of a packaging assembly being aligned and/or assembled, according to the present disclosure.
Figure 23:
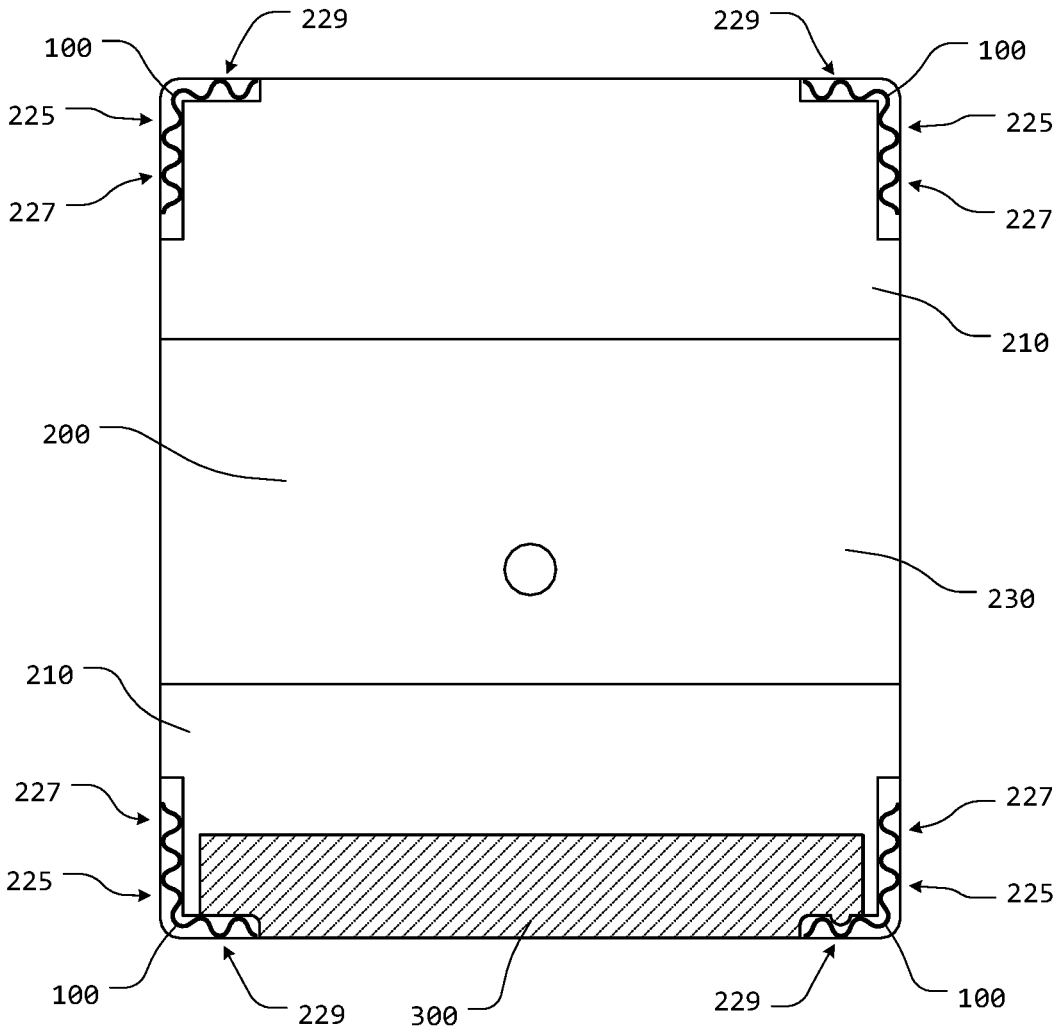
FIG. 23 illustrates a top view of one or more exemplary components of an exemplary embodiment of a packaging assembly aligned and/or assembled, according to the present disclosure.
Figure 24:
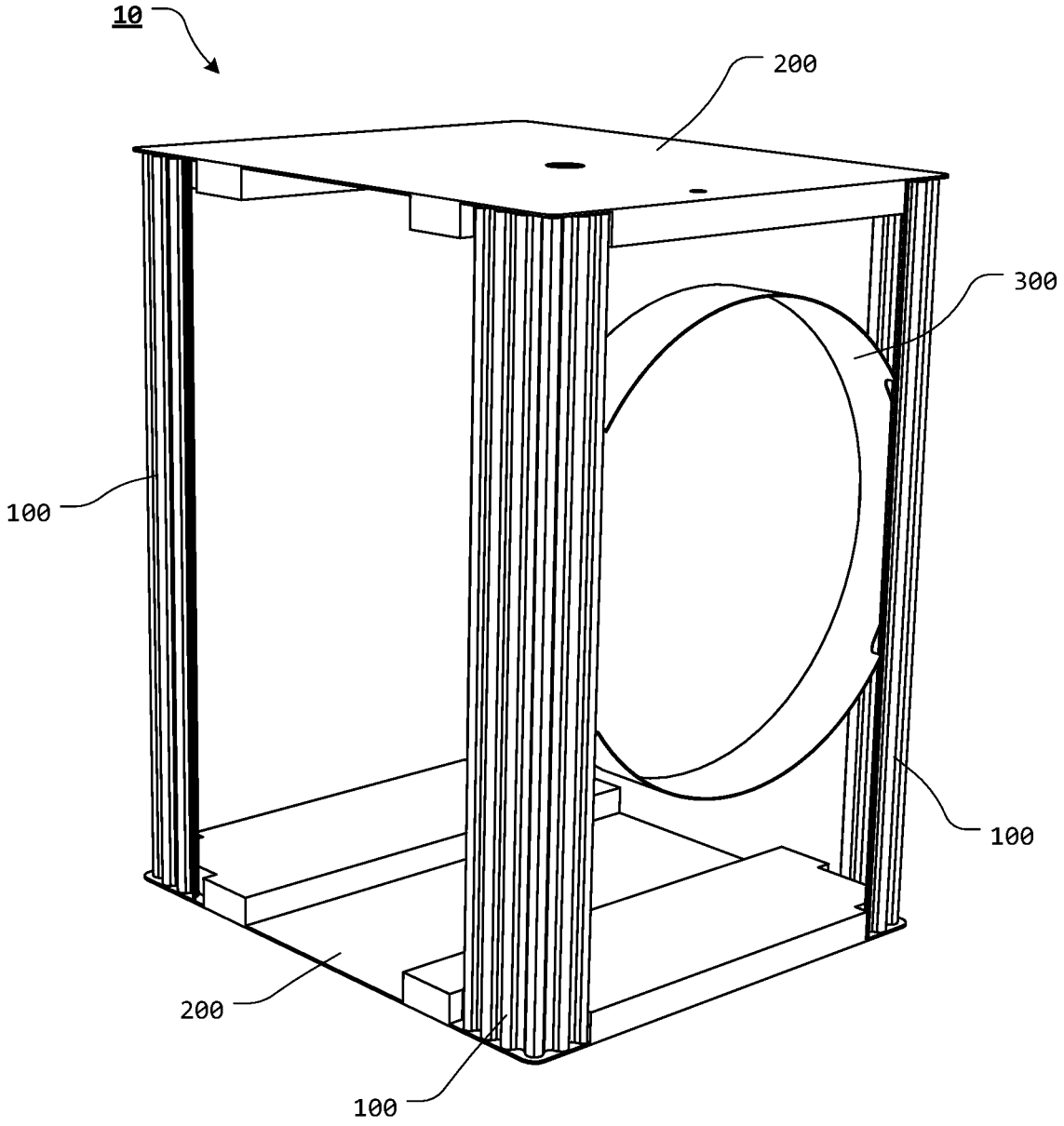
FIG. 24 illustrates an upper, front, left perspective view of one or more exemplary components of an exemplary embodiment of an assembled packaging assembly, according to the present disclosure.
Figure 25:
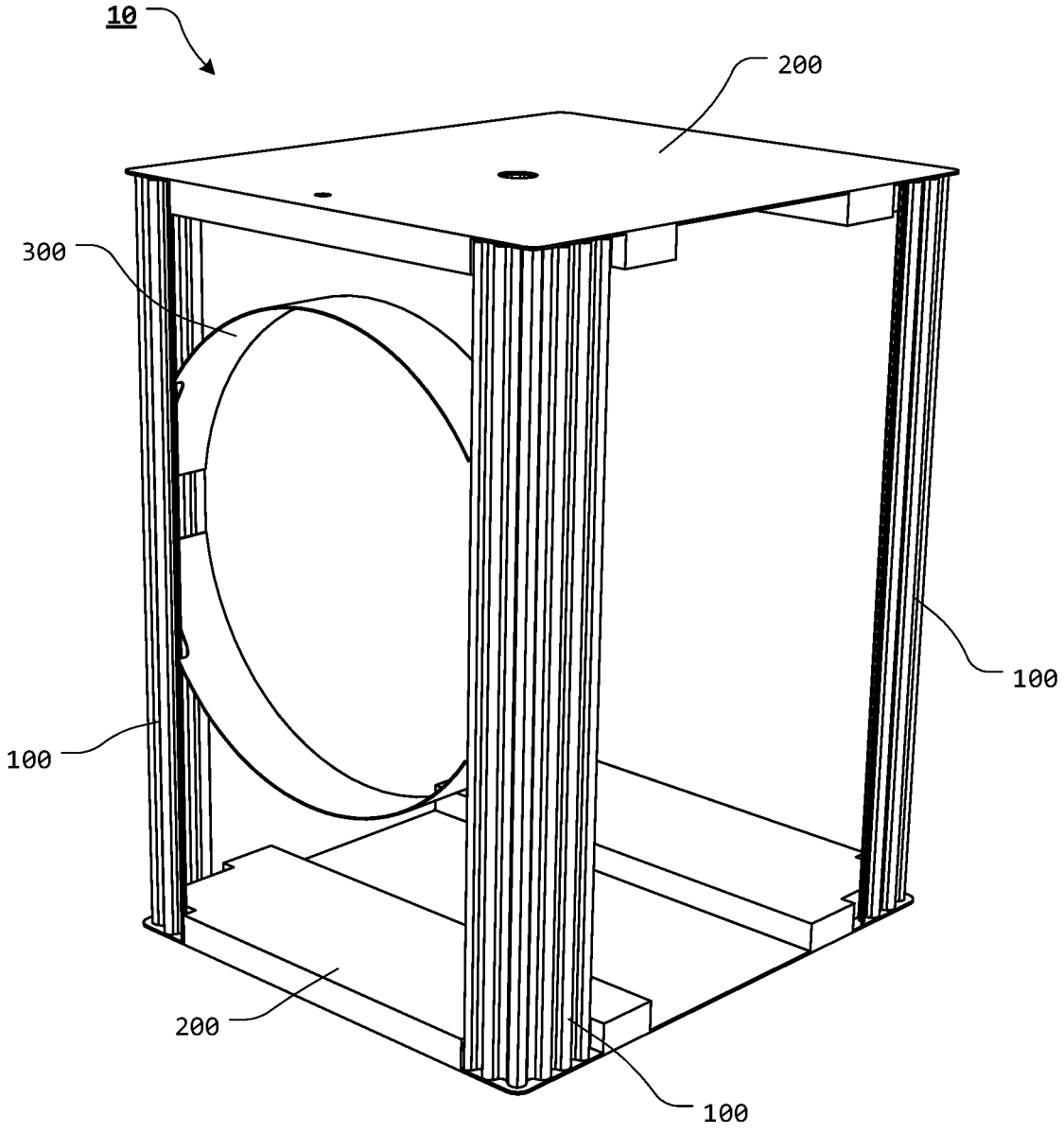
FIG. 25 illustrates an upper, front, right perspective view of one or more exemplary components of an exemplary embodiment of an assembled packaging assembly, according to the present disclosure.
Figure 26:
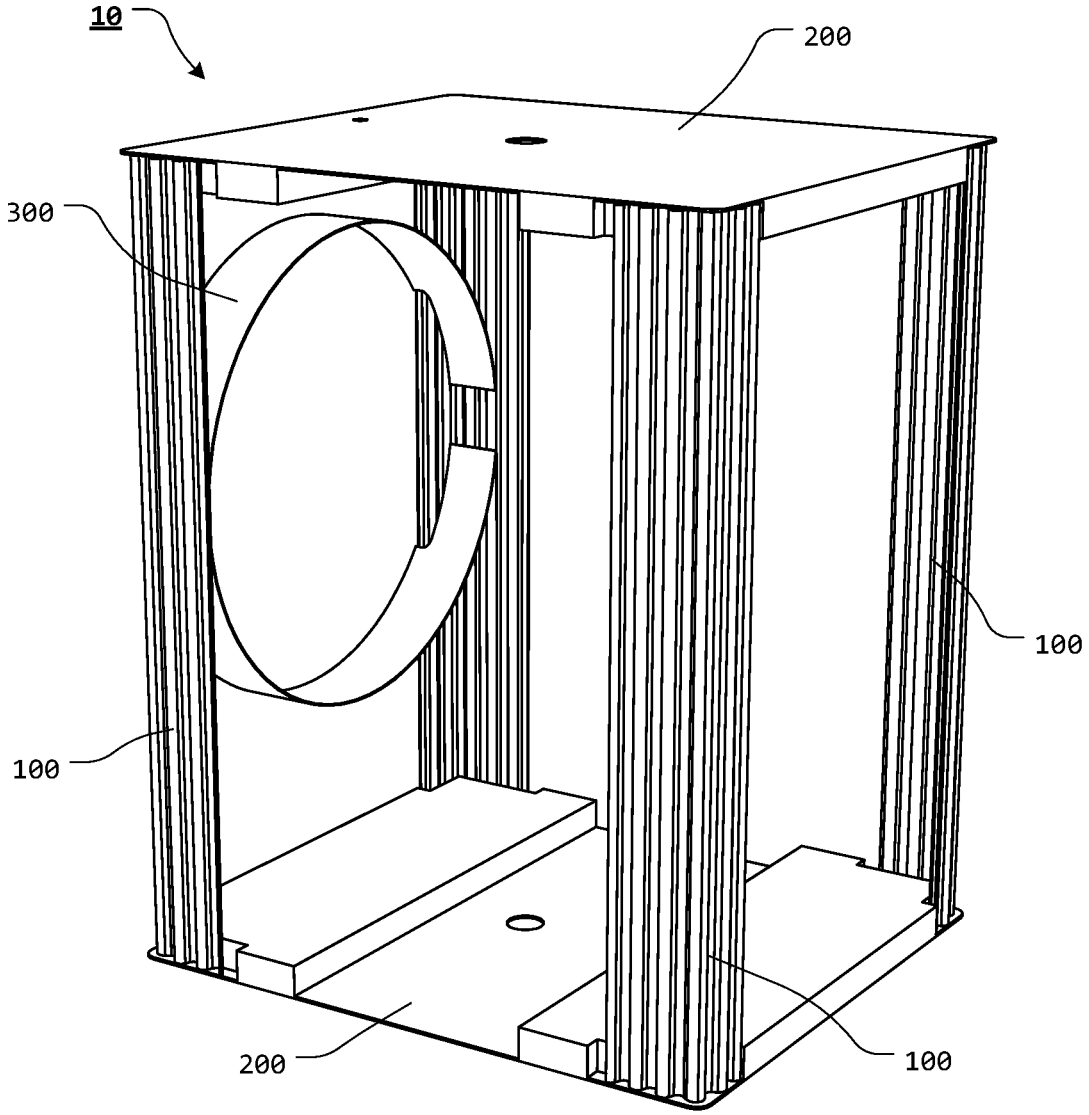
FIG. 26 illustrates an upper, rear, right perspective view of one or more exemplary components of an exemplary embodiment of an assembled packaging assembly, according to the present disclosure.
Figure 27:
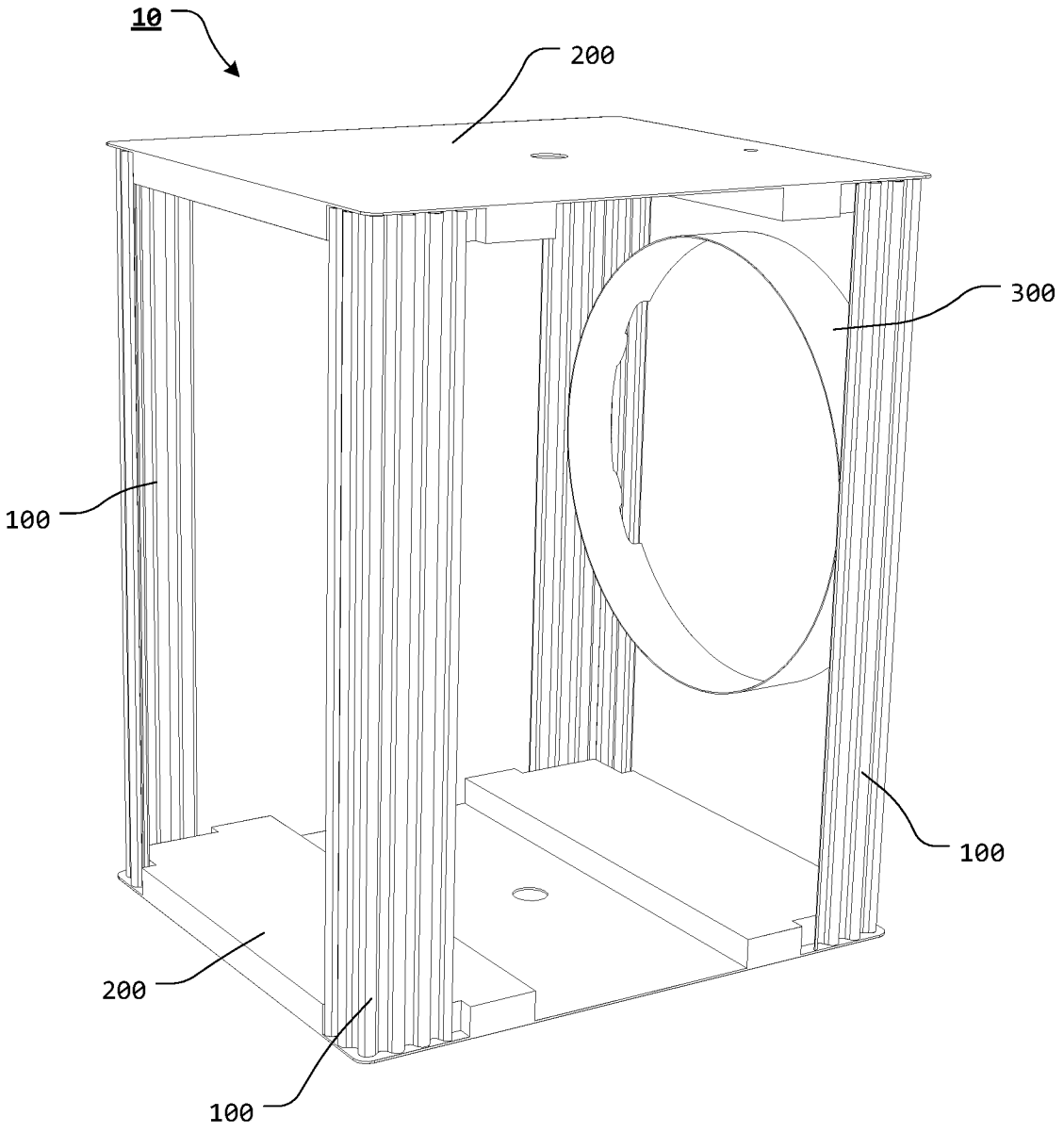
FIG. 27 illustrates an upper, rear, left perspective view of one or more exemplary components of an exemplary embodiment of an assembled packaging assembly, according to the present disclosure.

The corrugated corner elements 100 are sized to be positioned within the corner recesses 225 of the spaced apart endcap elements 200. As illustrated in FIGS. 20-21, when the support insert 300 is appropriately aligned with a portion of the article or product 400, a corrugated corner element 100 is aligned with each corner recess 225 and slidably positioned such that at least a portion of the first end portion 101 and the second end portion 102 are positioned within aligned corner recesses 225. If the first corner post element leg 110 is longer than the second corner post element leg 112, at least a portion of the first corner post element leg 110 is positioned within a first corner post recess portion 227, while a second corner post element leg 120 is positioned within a second corner post recess portion 229.

When positioned within the corresponding corner recesses 225, a terminal end of the second end portion 102 abuts against a top surface 231 of the at least one support layer portion 230, within the corner recess 225 of at least a partial tray layer portion 210 of a bottom or first endcap element 200. Likewise, a terminal end of the first end portion 101 abuts a top surface 231 of the at least one support layer portion 230, within the corner recess 225 of at least a partial tray layer portion 210 of a top or second endcap element 200. In this manner, the terminal ends of the second end portions 102 of the corrugated corner elements 100 are supported by the bottom or first endcap element 200 and the terminal ends of the first end portions 101 will the corrugated corner elements 100 support the top or second endcap element 200. Thus, the packaged article or product 400 is maintained within the spaced endcap elements 200 and the corrugated corner elements 100.

Each corner recess 225 is formed to engage at least a portion of the first end portion 101 or the second end portion 102 of one of the corrugated corner elements 100 at least partially therein. In various exemplary embodiments, each corner recess 225 is formed such that a corrugated corner element 100 is positionable therein, such that the corrugated corner elements 100 does not extend beyond a corner portion of each of the endcap elements 200.

In various exemplary embodiments, opposing end portions of each corner recess 225 are formed to include a notch, groove, or other surface or surface preparation that allows at least a portion of the first corner post element end 128 and the second corner post element end 129 to be at least partially captured or frictionally engaged against the end portions of each corner recess 225. Thus, during installation, the corrugated corner elements 100 may be flexed inward, relative to the vertex 122, to be positioned within the respective corner recesses 225. Once appropriately positioned within the respective corner recesses 225, the natural resilience of the corrugated corner element 100, causes the corrugated corner element 100 to resiliently recover to or toward the original shape of the corrugated corner element 100. This provides frictional or captured engagement of the corrugated corner element 100 within the respective corner recess 225.

When the corrugated corner elements 100, positioned adjacent the support insert 300 are appropriately positioned, the support insert 300 is potentially slidably positioned parallel to or along the longitudinal axis, $A_L$, of the corrugated corner element 100. However, interaction between the one or more projections 345 and the aligned the groove 124 resists movement of the support insert 300 perpendicular to the corrugated corner element 100. In this manner, the support insert 300 may be optimally positioned along the corrugated corner elements 100 to engage an appropriate portion of the article or product 400.

If the relief recess 330 does not include any projections, when the support insert 300 is aligned with a corrugated corner element 100, the support insert 300 is slidable or otherwise movable along the longitudinal axis, $A_L$, and perpendicular to the longitudinal axis, $A_L$, of the corrugated corner element 100.

FIGS. 22-37 illustrate various aspects of assembly of the packaging assembly 10 without an exemplary article or product 400 being positioned within the packaging assembly 10. It should be appreciated that these illustrations are included to provide ease of reference for the alignment and assembly of certain of the exemplary elements of the packaging assembly 10.

It should also be appreciated that the order of assembly of the various elements of the packaging assembly 10 may be modified, without departing from the spirit or scope of the present disclosure.

Once assembled, adjacent or abutted surfaces of the corrugated corner elements 100 and endcap elements 200 may optionally be bonded together, such as, by adhesives. Alternatively, portions of the corrugated corner elements 100 and endcap elements 200 may optionally be attached, coupled, fastened, secured, or bonded together, mechanically (i.e., via nails, screws, rivets, pins, or other fasteners) or as otherwise known in the art. In still other embodiments, the packaging assembly 10 may be wrapped in plastic or other material to further secure the corrugated corner elements 100, the support insert 300, and the endcap elements 200.

FIGS. 33-43 illustrate certain elements and/or aspects of an exemplary embodiment of the packaging assembly 20 with corrugated corner elements 100, two endcap elements 200, and a multi-slit support insert 500, according to the present disclosure. In illustrative, non-limiting embodiment(s) of the present disclosure, as illustrated in FIGS. 33-43, the support insert 300 of the packaging assembly 10 is replaced by at least one multi-slit support insert 500 to form the packaging assembly 20.

As illustrated most clearly in FIGS. 33-41, the multi-slit support insert 500 includes a multi-slit support insert body 510 that extends, along a longitudinal axis, $A_L$, of the multi-slit support insert 500, from a first terminal end 513 to a second terminal end 514. The multi-slit support insert body 510 also extends, substantially perpendicular to the longitudinal axis, $A_L$, of the multi-slit support insert 500, from a first end 511 to a second end 512.

Figure 40:
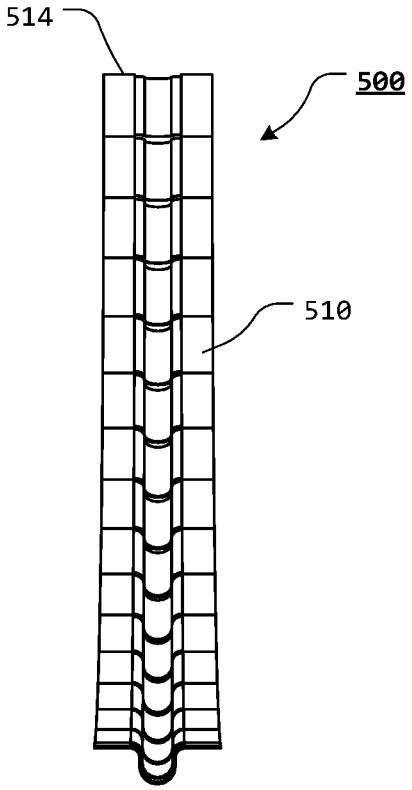
FIG. 40 illustrates a cross-sectional view, taken along line 40-40 of FIG. 34, of an exemplary embodiment of a multi-slit support insert, according to the present disclosure.

In various exemplary embodiments, the multi-slit support insert 500 is formed so as to have a substantially U-shaped cross-section, as illustrated, for example, in FIG. 40. As further illustrated, the end portions of the substantially U-shaped multi-slit support insert 500 extend away from one another, to form a pair of opposing, substantially planar, extension portions.

In various exemplary embodiments, the multi-slit support insert 500 is formed of a portion of corrugated or pleated fiberboard or cardboard.

A series of slits 515 are formed at spaced apart locations along at least a portion of an outer side surface 517 of the multi-slit support insert body 510.

Figure 34:
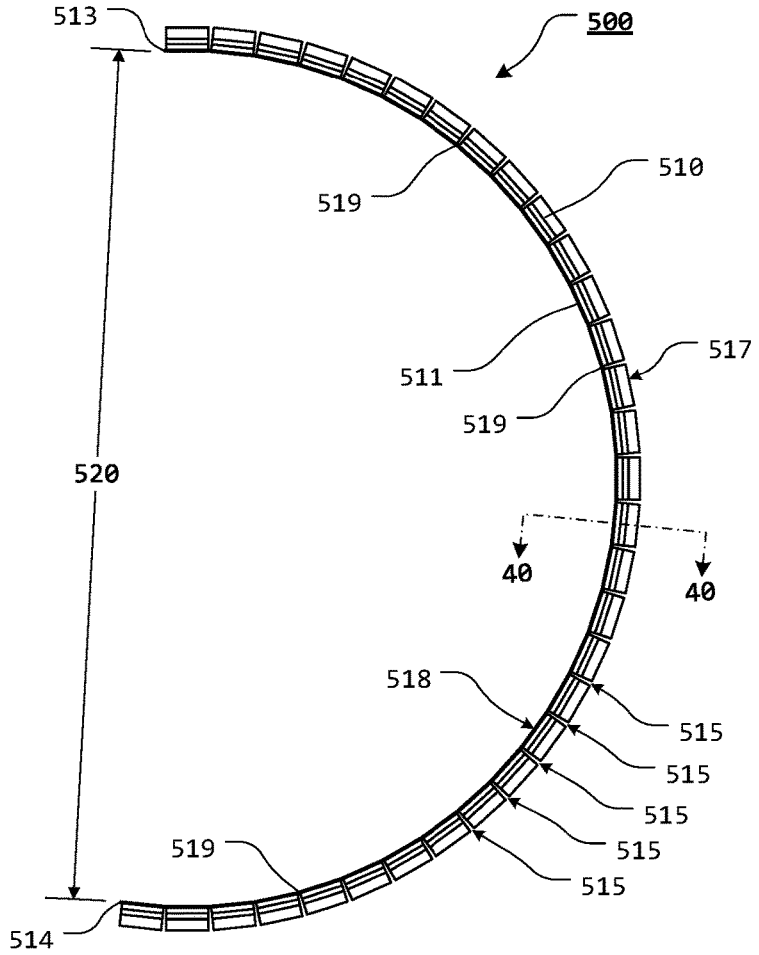
FIG. 34 illustrates a side view of an exemplary embodiment of a multi-slit support insert, according to the present disclosure.
Figure 35:
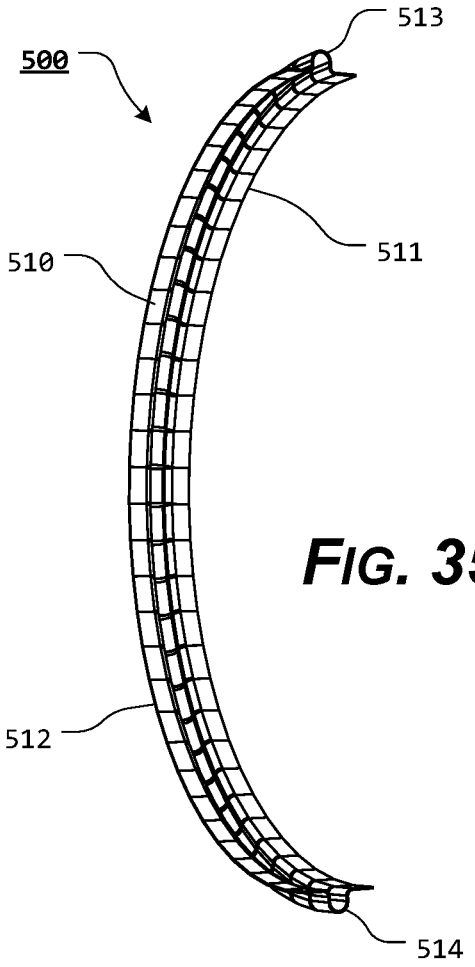
FIG. 35 illustrates a right, rear perspective view of an exemplary embodiment of a multi-slit support insert, according to the present disclosure.
Figure 36:
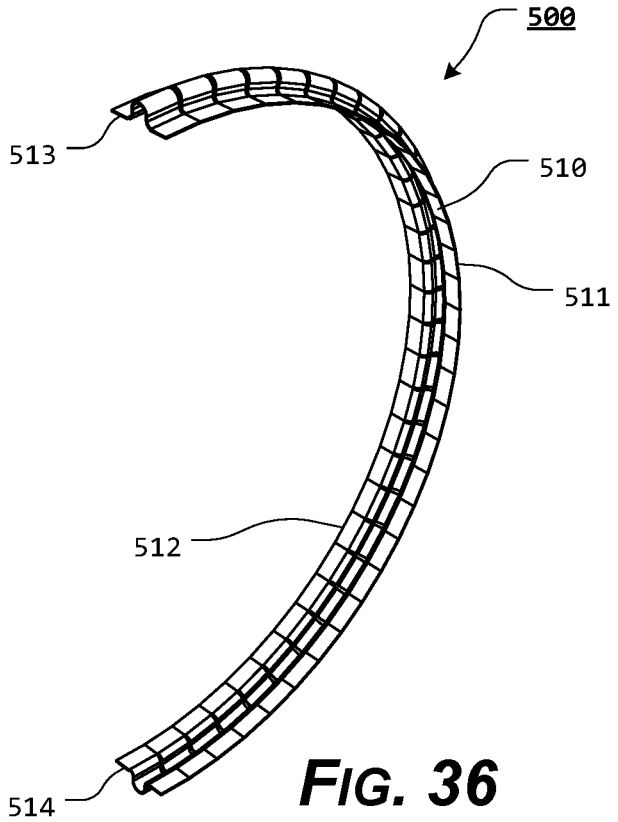
FIG. 36 illustrates a left, front perspective view of an exemplary embodiment of a multi-slit support insert, according to the present disclosure.
Figure 37:
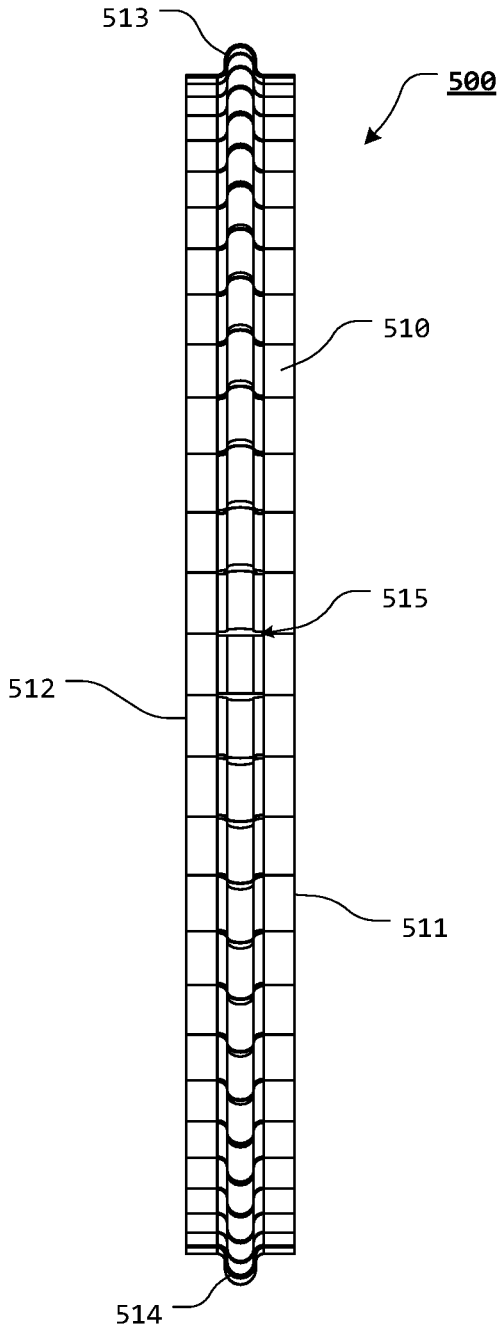
FIG. 37 illustrates a left side view of an exemplary embodiment of a multi-slit support insert, according to the present disclosure.
Figure 38:
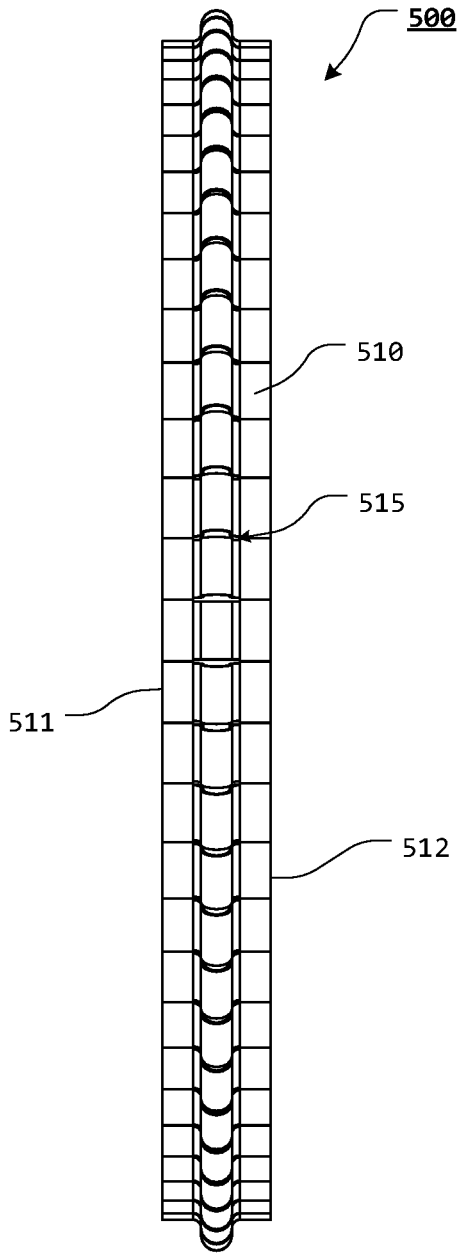
FIG. 38 illustrates a right side view of an exemplary embodiment of a multi-slit support insert, according to the present disclosure.
Figure 39:
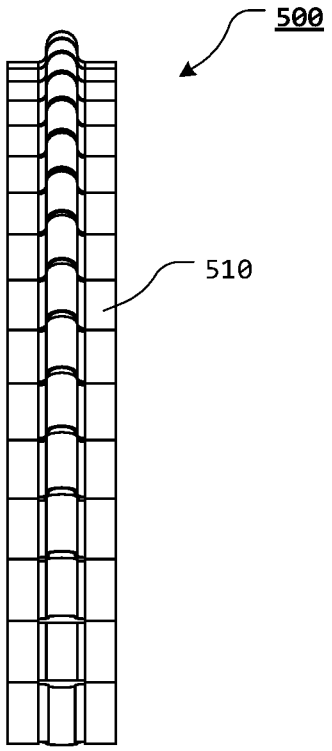
FIG. 39 illustrates a top view of an exemplary embodiment of a multi-slit support insert, according to the present disclosure, it being understood that the bottom view of the multi-slit support insert is a substantial mirror image of the top view.
Figure 41:
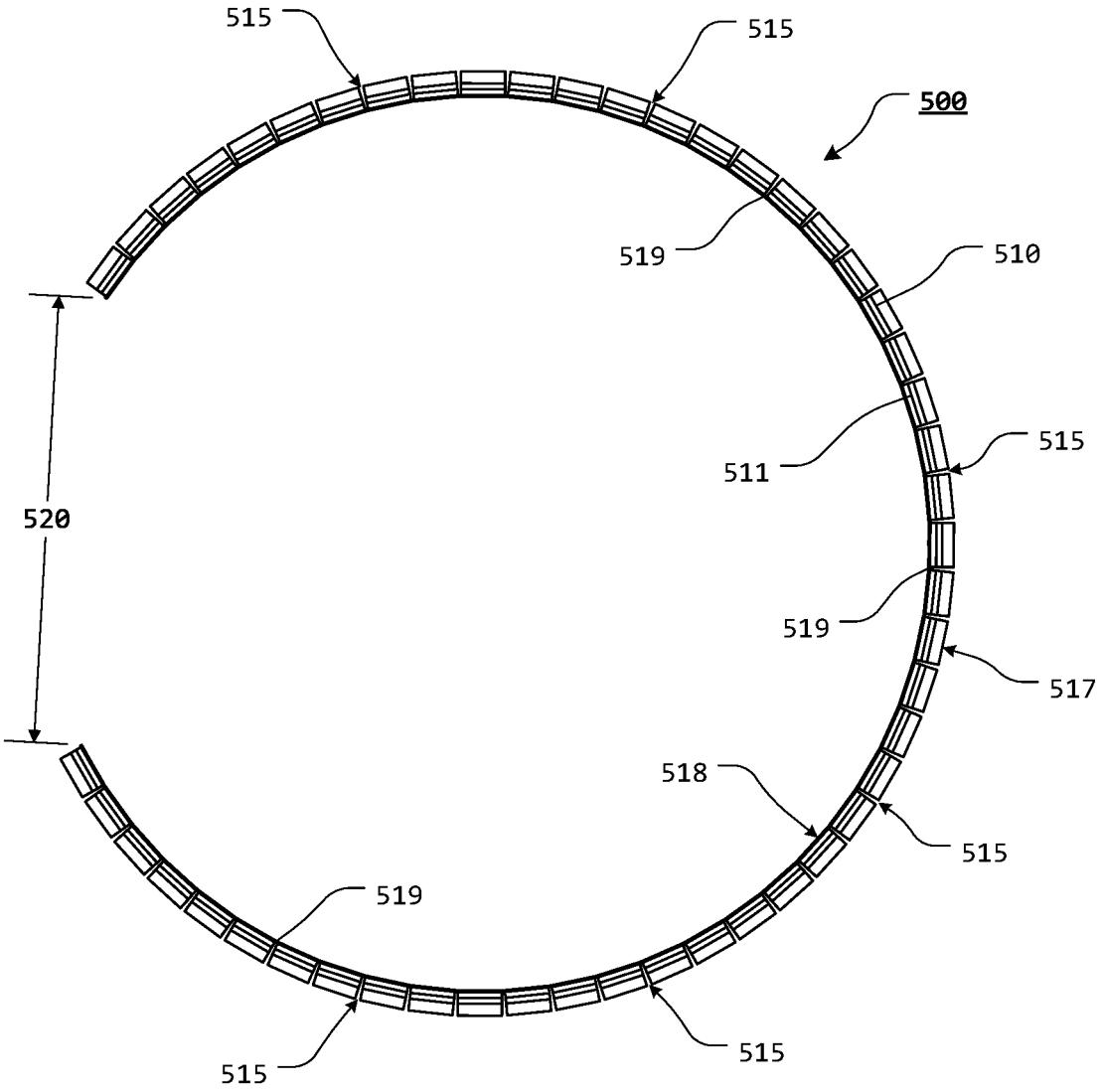
FIG. 41 illustrates a side view of an exemplary embodiment of a multi-slit support insert, according to the present disclosure.

Providing a plurality or series of slits 515 allows the material of the multi-slit support insert body 510 to be more easily bent, along the longitudinal axis, $A_L$, of the multi-slit support insert 500, to more easily form an even or consistent bend of the multi-slit support insert body 510 to form a partial cylinder, having a substantially circular cross-sectional view, when viewed from the first end 511 or the second end 512, as illustrated in FIGS. 34 and 41.

In certain exemplary, nonlimiting embodiments, each of the one or more slits 515 is formed of a partial cut or recess extending into the multi-slit support insert body 510, from a portion of an outer side surface 517 of the multi-slit support insert body 510, toward the inner side surface 518 of the multi-slit support insert body 510.

In certain exemplary embodiments, each of the one or more slits 515 is formed so as to extend substantially perpendicular to the longitudinal axis, $A_L$, of the multi-slit support insert body 510. Each slit 515 may optionally be formed so as to extend from a portion of the outer side surface 517 of the multi-slit support insert body 510, forming a web 519 proximate the inner side surface 518.

Each of the one or more slits 515 provides a remaining portion of material, forming a web 519, along which the multi-slit support insert body 510 may be comparatively more easily bent, whether along the grain or against the grain of the multi-slit support insert body 510. Thus, the one or more slits 515 may optionally provide a reduced or weakened area or portion of the multi-slit support insert body 510, along which the multi-slit support insert body 510 may be comparatively more easily bent.

In certain exemplary embodiments, each of the one or more slits 515 are formed equidistant from each other. Alternatively, the one or more slits 515 may be formed at varying distances from one another.

It should be appreciated that the number of slits 515 utilized to form the multi-slit support insert body 510 is a design choice, based upon the overall size and/or shape of the multi-slit support insert body 510 or other factors.

Figure 33:
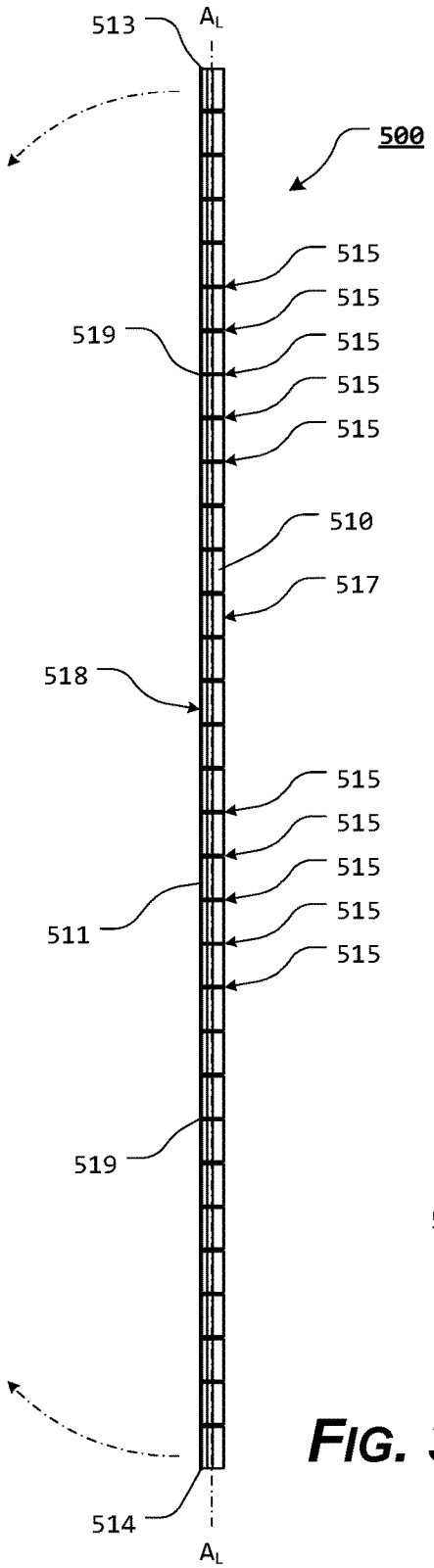
FIG. 33 illustrates a side view of an exemplary embodiment of a multi-slit support insert body used to form a multi-slit support insert, according to the present disclosure.

By bending the multi-slit support insert body 510 along the one or more slits 515, as illustrated by the semicircular arrows in FIG. 33, the multi-slit support insert body 510 can be more easily bent to form a circular, semicircular, or crescent shaped multi-slit support insert 500.

By bending the multi-slit support insert body 510 along the one or more slits 515, an optional gap 520 is formed between portions of the multi-slit support insert body 510, between the first terminal end 513 and the second terminal end 514. If included, the gap 520 allows for a degree of inward and/or outward flexion of the multi-slit support insert body 510. By providing a degree of inward and/or outward flex station of the multi-slit support insert body 510, the multi-slit support insert 500 can be expanded or contracted to be appropriately fitted within or about at least a portion of an article or product 400. For example, the multi-slit support insert body 510 may be flexed to be appropriately fitted within or around at least a portion of a door 410 of a front loading laundry washer or dryer article or product 400.

In certain exemplary embodiments, the gap 520 is formed within the multi-slit support insert body 510 to allow a portion of the article or product 400, such as, for example, a hinge, door pole, or the like, to be at least partially fitted within the gap 520.

While the multi-slit support insert 500 is initially illustrated as forming a semicircle, having a substantially circular front or rear view, it should be appreciated that the multi-slit support insert 500 is not so limited. Thus, for example, the multi-slit support insert 500 may optionally be bent into the shape of an oval, a triangle, a rectangle, a square, a pentagon, a hexagon, a heptagon, an octagon, a nanogon, a decagon, a pentadecagon, an icosagon, or any other desired shape or configuration. Thus, it should be appreciated that the size and shape of each of the multi-slit support insert 500 is a design choice based upon the size and/or shape of a door or other feature of the article or product 400 with which the multi-slit support insert 500 and/or the packaging assembly 20 is to be utilized.

Figure 42:
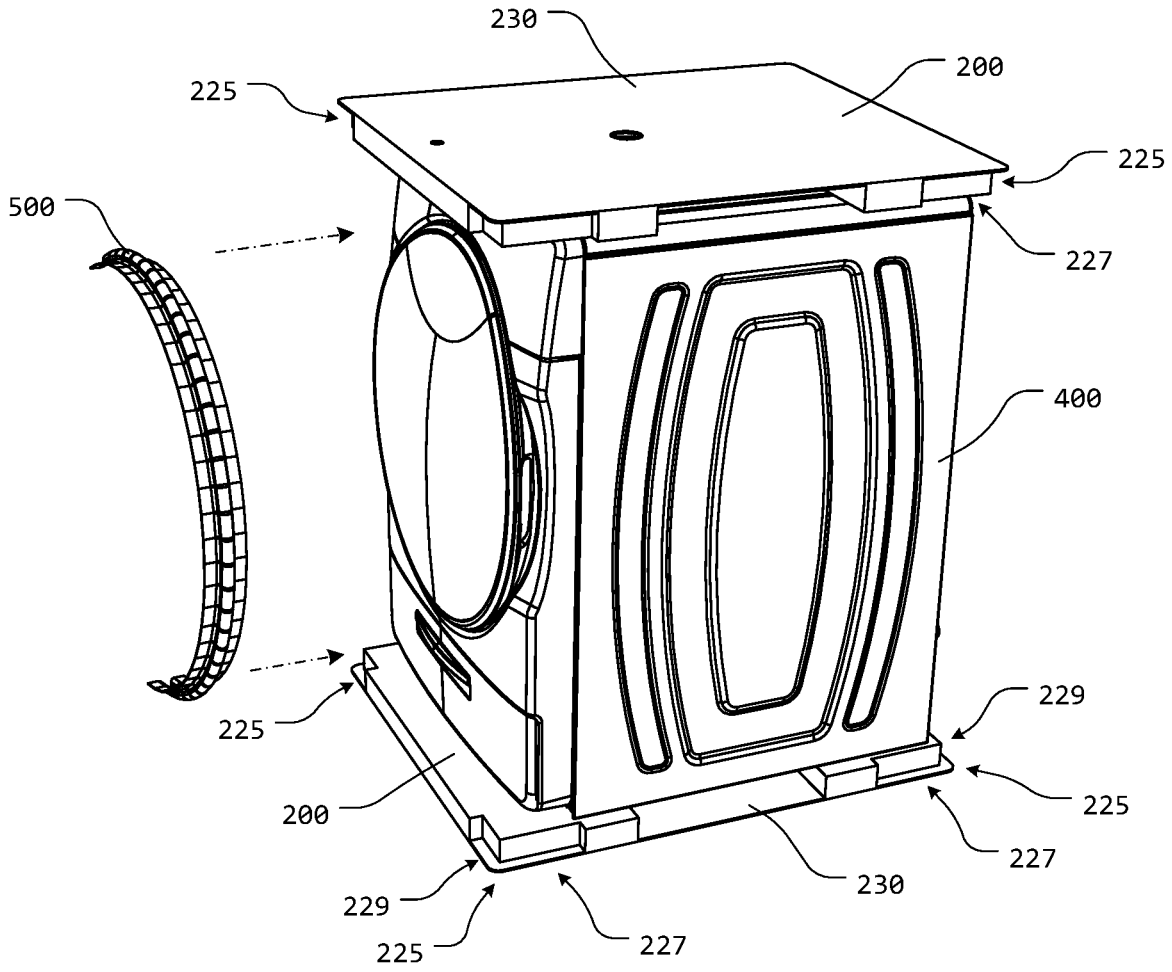
FIG. 42 illustrates an upper, perspective view of one or more exemplary components of an exemplary embodiment of a packaging assembly including a multi-slit support insert being aligned and/or assembled, according to the present disclosure.
Figure 43:
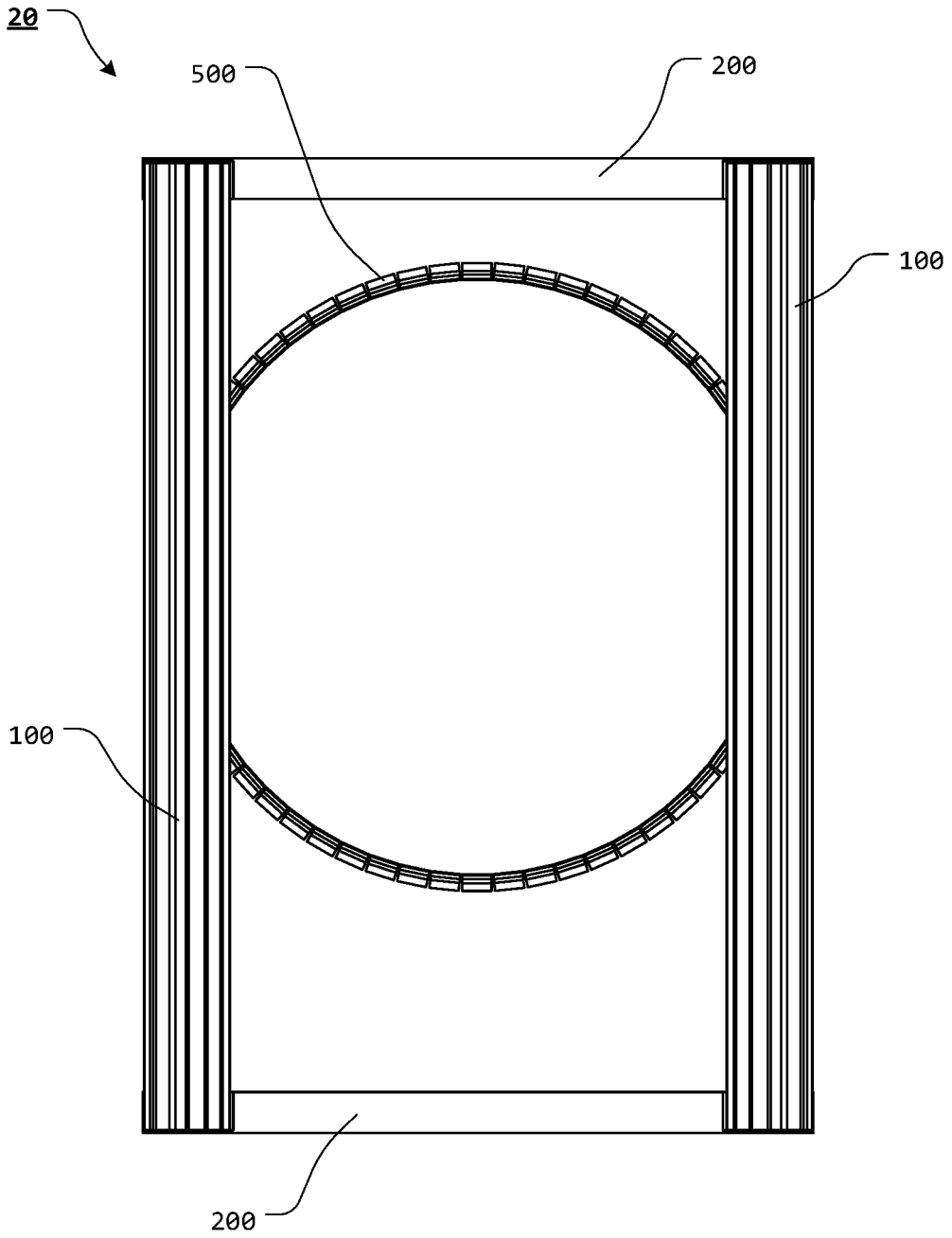
FIG. 43 illustrates a front view of one or more exemplary components of an exemplary embodiment of an assembled packaging assembly including a multi-slit support insert, according to the present disclosure.

Assembly of the packaging assembly 20 is illustrated generally in FIG. 42, using an exemplary article or product 400, while the packaging assembly 20 is illustrated in FIG. 43, as being assembled without an exemplary article or product 400, for ease of reference.

While the article or product 400 is illustrated as being a front loading laundry washer or dryer, it should be appreciated that the article or product 400 may be any desired appliance, article, or product to be packaged for shipping.

During assembly of the packaging assembly 20, at least a portion of the multi-slit support insert body 510 is bent, along the longitudinal axis, $A_L$, of the multi-slit support insert body 510, such that the first terminal end 513 is urged toward the second terminal end 514 to allow at least a portion of the multi-slit support insert body 510 to be fitted within at least a portion of the packaging assembly 20 such that separate portions of the multi-slit support insert body 510 contact at least a portion of the inner wall 130 of two adjacent corrugated corner elements 100. In certain exemplary embodiments, a portion of the first terminal end 513 and a portion of the second terminal end 514 each contact at least a portion of the inner wall 130 of one of the corrugated corner elements 100.

It should be appreciated that assembly and use of the packaging assembly 20 is substantially similar to assembly and use of the packaging assembly 10, as illustrated in FIGS. 18-21, utilizing the corrugated corner elements 100 and the endcap elements 200, as illustrated in FIGS. 1-6, but utilizing the multi-slit support insert 500 in place of the support insert 300.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Furthermore, where a range of values or dimensions is provided, it is understood that every intervening value or dimension, between the upper and lower limit of that range and any other stated or intervening value or dimension in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A packaging assembly, comprising:

two or more corrugated corner elements, wherein each of said corrugated corner elements includes an outer wall and an opposing inner wall, wherein each of said corrugated corner elements extends lengthwise, along a longitudinal axis, continuously from a first end portion to a second end portion, wherein each of said corrugated corner elements includes a first corner post element leg, wherein said first corner post element leg has one or more alternating ridges and grooves, wherein each of said alternating ridges and grooves extends along said longitudinal axis of each of said corrugated corner elements, wherein each of said corrugated corner elements includes a second corner post element leg, wherein said second corner post element leg has one or more alternating ridges and grooves, wherein each of said alternating ridges and grooves extends along said longitudinal axis of each of said corrugated corner elements, wherein said first corner post element leg and said second corner post element leg each extend from a vertex, and wherein each said vertex extends along said longitudinal axis of each of said corrugated corner elements;

two spaced endcap elements, wherein each endcap element includes a support layer portion and a tray layer portion, wherein said support layer portion extends to two or more corners, wherein said tray layer portion includes a corner recess formed proximate each corner of said support layer portion, and wherein each of said corrugated corner elements is formed to be at least partially positioned within a respective one of said corner recesses; and a multi-slit support insert having a multi-slit support insert body extending substantially parallel a longitudinal axis of said multi-slit support insert, from a first terminal end to a second terminal end and extending substantially perpendicular to said longitudinal axis of said multi-slit support insert, from a first end to a second end, wherein one or more slits are formed at spaced apart locations along at least a portion of an outer side surface of said multi-slit support insert body, wherein each of said one or more slits is formed of a cut extending from a portion of said outer side surface toward an inner side surface of said multi-slit support insert body, wherein each of said one or more slits leaves a remaining portion of said multi-slit support insert body defining a web proximate said inner side surface of said multi-slit support insert body, wherein at least a portion of said multi-slit support insert body is bent, along said longitudinal axis of said multi-slit support insert, such that said first terminal end is urged toward said second terminal end to allow at least a portion of said multi-slit support insert body to be fitted within at least a portion of said packaging assembly such that separate portions of said multi-slit support insert body contact at least a portion of said inner wall of two of said corrugated corner elements.

2. The packaging assembly of claim 1, wherein said multi-slit support insert body is formed of a portion of corrugated fiberboard or cardboard.

3. The packaging assembly of claim 1, wherein each of said one or more slits is formed so as to extend substantially perpendicular to said longitudinal axis of said multi-slit support insert body.

4. The packaging assembly of claim 1, wherein each web defined by each of said one or more slits provides a portion of said multi-slit support insert body that may be comparatively more easily bent.

5. The packaging assembly of claim 1, wherein each web defined by each of said one or more slits provides a reduced portion of said multi-slit support insert body, along which said multi-slit support insert body may be comparatively more easily bent.

6. The packaging assembly of claim 1, wherein said multi-slit support insert body is formed so as to have a substantially U-shaped cross-section and wherein end portions of said multi-slit support insert body extend away from one another, to form a pair of opposing, substantially planar, extension portions.

7. The packaging assembly of claim 1, wherein each of said one or more slits is formed equidistant from each adjacent one of said one or more slits.

8. The packaging assembly of claim 1, wherein a gap is formed between said first terminal end and said second terminal end of said multi-slit support insert body.

9. The packaging assembly of claim 1, wherein a portion of said first terminal end and a portion of said second terminal end each contact at least a portion of said inner wall of one of said corrugated corner elements.

10. The packaging assembly of claim 1, wherein said tray layer portion comprises a separate portion of material that is attached or coupled to said support layer portion.

11. The packaging assembly of claim 1, wherein said tray layer portion and said support layer portion are formed integral to one another to form a monolithic endcap element.

12. The packaging assembly of claim 1, wherein each of said corrugated corner elements is formed to be at least partially flexed inwardly, relative to said vertex, to be positioned within a respective one of said corner recesses.

13. The packaging assembly of claim 1, wherein each corner recess is formed to substantially abut at least a portion of an inner wall of at least a first end portion or a second end portion of each of said corrugated corner elements.

14. A packaging assembly, comprising:

at least four corrugated corner elements, each of said corrugated corner elements having an outer wall and an opposing inner wall, each of said corrugated corner elements extending lengthwise, along a longitudinal axis, continuously from a first end portion to a second end portion, each of said corrugated corner elements having a first corner post element leg, said first corner post element leg having one or more alternating ridges and grooves, each of said alternating ridges and grooves extending along said longitudinal axis of each of said corrugated corner elements, each of said corrugated corner elements having a second corner post element leg, said second corner post element leg having one or more alternating ridges and grooves, each of said alternating ridges and grooves extending along said longitudinal axis of each of said corrugated corner elements, said first corner post element leg and said second corner post element leg each extending laterally from a vertex;

two spaced endcap elements, each endcap element having a support layer portion and a tray layer portion, said support layer portion extending to four or more corners, said tray layer portion including a corner recess formed proximate each corner of said support layer portion, and each of said corrugated corner elements formed to be at least partially positioned within a respective one of said corner recesses; and a multi-slit support insert having a multi-slit support insert body extending substantially parallel a longitudinal axis of said multi-slit support insert, from a first terminal end to a second terminal end and extending substantially perpendicular to said longitudinal axis of said multi-slit support insert, from a first end to a second end, one or more slits being formed at spaced apart locations along at least a portion of an outer side surface of said multi-slit support insert body, each of said one or more slits being formed of a cut extending from a portion of said outer side surface toward an inner side surface of said multi-slit support insert body, each of said one or more slits leaving a remaining portion of said multi-slit support insert body defining a web proximate said inner side surface of said multi-slit support insert body, at least a portion of said multi-slit support insert body being bent such that said first terminal end is urged toward said second terminal end to allow at least a portion of said multi-slit support insert body to be fitted within at least a portion of said packaging assembly such that separate portions of said multi-slit support insert body contact at least a portion of said inner wall of two of said corrugated corner elements.

15. The packaging assembly of claim 14, wherein each web defined by each of said one or more slits provides a portion of said multi-slit support insert body that may be comparatively more easily bent.

16. The packaging assembly of claim 14, wherein each web defined by each of said one or more slits provides a reduced portion of said multi-slit support insert body, along which said multi-slit support insert body may be comparatively more easily bent.

17. The packaging assembly of claim 14, wherein a gap is formed between said first terminal end and said second terminal end of said multi-slit support insert body.

18. The packaging assembly of claim 14, wherein a portion of said first terminal end and a portion of said second terminal end each contact at least a portion of said inner wall of one of said corrugated corner elements.

19. A packaging assembly, comprising:

at least four corrugated corner elements, wherein each of said corrugated corner elements includes an outer wall and an opposing inner wall, wherein each of said corrugated corner elements extends lengthwise, along a longitudinal axis, from a first end portion to a second end portion, wherein each of said corrugated corner elements includes a first corner post element leg, wherein said first corner post element leg includes one or more alternating ridges and grooves, wherein each of said alternating ridges and grooves extends along said longitudinal axis of each of said corrugated corner elements, wherein each of said corrugated corner elements includes a second corner post element leg, wherein said second corner post element leg includes one or more alternating ridges and grooves, wherein each of said alternating ridges and grooves extends along said longitudinal axis of each of said corrugated corner elements, wherein said first corner post element leg and said second corner post element leg each extend from a vertex;

two spaced endcap elements, wherein each endcap element includes a support layer portion and a tray layer portion, wherein said support layer portion extends to four or more corners, wherein said tray layer portion includes a corner recess formed proximate each corner of said support layer portion, and wherein each of said corrugated corner elements is formed to be at least partially positioned within a respective one of said corner recesses; and a multi-slit support insert having a multi-slit support insert body extending from a first terminal end to a second terminal end and extending from a first end to a second end, wherein one or more slits are formed at spaced apart locations along at least a portion of said multi-slit support insert body, wherein each of said one or more slits is formed of a cut extending from a portion of an outer side surface of said multi-slit support insert body toward an inner side surface of said multi-slit support insert body, wherein each of said one or more slits leaves a remaining portion of said multi-slit support insert body defining a web proximate said inner side surface of said multi-slit support insert body, wherein at least a portion of said multi-slit support insert body is bent such that said first terminal end is urged toward said second terminal end to allow at least a portion of said multi-slit support insert body to be fitted within at least a portion of said packaging assembly such that separate portions of said multi-slit support insert body contact at least a portion of said inner wall of two of said corrugated corner elements.

20. The packaging assembly of claim 19, wherein a portion of said first terminal end and a portion of said second terminal end each contact at least a portion of said inner wall of one of said corrugated corner elements.

* * * * *